US011062670B2

(12) United States Patent
Lee et al.

(10) Patent No.: US 11,062,670 B2
(45) Date of Patent: Jul. 13, 2021

(54) GATE DRIVING CIRCUIT AND DISPLAY DEVICE INCLUDING THE SAME

(71) Applicant: Samsung Display Co., Ltd., Yongin-si (KR)

(72) Inventors: Jaehoon Lee, Seoul (KR); Bonghyun You, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 319 days.

(21) Appl. No.: 15/215,516

(22) Filed: Jul. 20, 2016

(65) Prior Publication Data

US 2017/0116949 A1 Apr. 27, 2017

(30) Foreign Application Priority Data

Oct. 21, 2015 (KR) ..... 10-2015-0146919

(51) Int. Cl.
*G09G 3/36* (2006.01)

(52) U.S. Cl.
CPC ..... *G09G 3/3688* (2013.01); *G09G 3/3677* (2013.01); *G09G 2310/0202* (2013.01); *G09G 2310/0286* (2013.01); *G09G 2310/0289* (2013.01); *G09G 2310/08* (2013.01)

(58) Field of Classification Search
CPC ..... G09G 3/3688; G09G 3/3677; G09G 2310/0286; G09G 2310/0202; G09G 2310/0289; G09G 2310/08; G09G 3/36
See application file for complete search history.

(56) References Cited

U.S. PATENT DOCUMENTS 8,462,097 B2 * 6/2013 Kim ..... G09G 3/3677 345/100
8,754,674 B2 * 6/2014 Lee ..... G09G 3/3677 327/108
8,860,648 B2 * 10/2014 Lee ..... G11C 19/28 345/100
8,860,652 B2 * 10/2014 Yamashita ..... G09G 3/3674 345/100
9,406,272 B2 * 8/2016 Lee ..... G09G 3/3677
(Continued)

FOREIGN PATENT DOCUMENTS

KR 10-0863502 B1 10/2008
KR 10-2012-0072465 A 7/2012
(Continued)

*Primary Examiner* — Jeff Piziali
(74) *Attorney, Agent, or Firm* — Lewis Roca Rothgerber Christie LLP

(57) ABSTRACT

A gate driving circuit includes driving stages for providing gate signals to gate lines of a display panel. A k-th driving stage a k-th driving stage (k being equal to or greater than 2) among the driving stages includes a gate output unit configured to output a clock signal as a k-th gate signal in response to a voltage of a first node, a carry output unit configured to output the clock signal as a k-th carry signal in response to the voltage of the first node, a control unit configured to control a voltage level of the first node in response to a (k−1)th carry signal, a first discharge unit configured to discharge the k-th carry signal to a voltage level in response to the (k−1)th carry signal, and a second discharge unit configured to discharge the k-th carry signal to a voltage level in response to a discharge signal.

17 Claims, 19 Drawing Sheets

(56) References Cited

U.S. PATENT DOCUMENTS

| | | | | |
|---|---|---|---|---|
| 9,685,948 | B2 * | 6/2017 | Kim | H03K 17/693 |
| 9,870,730 | B2 * | 1/2018 | Kim | G09G 3/2092 |
| 2007/0248204 | A1 * | 10/2007 | Tobita | G11C 19/28 377/64 |
| 2008/0055225 | A1 * | 3/2008 | Pak | G09G 3/3677 345/96 |
| 2008/0136756 | A1 * | 6/2008 | Yeo | G09G 3/3677 345/87 |
| 2010/0164854 | A1 | 7/2010 | Kim et al. | |
| 2010/0277206 | A1 * | 11/2010 | Lee | G09G 3/3677 327/108 |
| 2011/0069044 | A1 * | 3/2011 | Lee | G11C 19/28 345/204 |
| 2011/0122117 | A1 * | 5/2011 | Lee | G09G 3/3677 345/211 |
| 2012/0268194 | A1 * | 10/2012 | Koyama | H01L 27/1296 327/427 |
| 2012/0293467 | A1 | 11/2012 | Lee et al. | |
| 2013/0106677 | A1 * | 5/2013 | Koo | G11C 19/28 345/87 |

FOREIGN PATENT DOCUMENTS

| | | | |
|---|---|---|---|
| KR | 10-2013-0016699 | A | 2/2013 |
| KR | 10-2013-0049617 | A | 5/2013 |
| KR | 10-1275248 | B1 | 6/2013 |
| KR | 10-2013-0142454 | A | 12/2013 |
| KR | 10-2014-0043203 | A | 4/2014 |
| KR | 10-1573460 | B1 | 12/2015 |

* cited by examiner

GATE DRIVING CIRCUIT AND DISPLAY DEVICE INCLUDING THE SAME

CROSS-REFERENCE TO RELATED APPLICATION

This application claims priority to, and the benefit of, Korean Patent Application No. 10-2015-0146919, filed on Oct. 21, 2015, the entire content of which is incorporated herein by reference.

BACKGROUND

1. Field

The present disclosure herein relates to a gate driving circuit and a display device including the same.

2. Description of the Related Art

A display device includes a plurality of gate lines, a plurality of data lines, and a plurality of pixels respectively connected to the plurality of gate lines and the plurality of data lines. The display device includes a gate driving circuit for sequentially providing gate signals to the plurality of gate lines, and Includes a data driving circuit for outputting data signals to the plurality of data lines.

The gate driving circuit includes a shift register with a plurality of driving circuits (hereinafter referred to as driving stages). The plurality of driving stages respectively output gate signals corresponding to the plurality of gate lines. Each of the plurality of driving stages includes a plurality of organically-connected transistors.

Recently, various efforts are made to reduce the size of a gate driving circuit.

SUMMARY

The present disclosure reduces the area of a gate driving circuit, and also provides a display device including a gate driving circuit with a reduced area.

An embodiment of the Inventive concept provides a gate driving circuit including driving stages for providing gate signals to gate lines of a display panel, wherein a k-th driving stage (k being a natural number equal to or greater than 2) among the driving stages includes a gate output unit configured to output a clock signal as a k-th gate signal in response to a voltage of a first node, a carry output unit configured to output the clock signal as a k-th carry signal in response to the voltage of the first node, a control unit configured to control a voltage level of the first node in response to a (k−1)th carry signal, a first discharge unit configured to discharge the k-th carry signal to a voltage level in response to the (k−1)th carry signal, and a second discharge unit configured to discharge the k-th carry signal to a voltage level in response to a discharge signal.

The second discharge unit may be further configured to discharge the first node and the k-th gate signal to a voltage level in response to the discharge signal.

The second discharge unit may be configured to discharge the k-th gate signal to a first ground voltage, and may be configured to discharge the k-th carry signal and the first node to a second ground voltage, the first discharge unit may be configured to discharge the k-th carry signal to the first ground voltage, and the first ground voltage and the second ground voltage may include different voltage levels.

The discharge signal may include the (k+1)th carry signal.

The second discharge unit may include a second discharge transistor including a first electrode configured to receive the k-th carry signal, a second electrode configured to receive the second ground voltage, and a control electrode configured to receive the (k+1)th carry signal.

The first discharge unit may include a first discharge transistor including a first electrode configured to receive the k-th carry signal, a second electrode configured to receive the second ground voltage, and a control electrode configured to receive the (k−1)th carry signal.

The k-th driving stage may further include a glitch prevention unit configured to maintain a voltage level of the first node as the k-th carry signal level in response to the clock signal.

The glitch prevention unit may include a transistor including a first electrode connected to the first node, a second electrode configured to receive the k-th carry signal, and a control electrode configured to receive the clock signal.

The second discharge unit may be configured to discharge the k-th gate signal to a first ground voltage, and is configured to discharge the first node and the k-th carry signal to a second ground voltage, the first discharge unit may be configured to discharge the k-th carry signal to the second ground voltage, and the first ground voltage and the second ground voltage may include different voltage levels.

The discharge signal may include an inversion clock signal that is complementary to the clock signal.

The second discharge unit may include a second discharge transistor including a first electrode configured to receive the k-th carry signal, a second electrode configured to receive the second ground voltage, and a control electrode configured to receive the (k+1)th carry signal.

The second discharge unit may further include a third discharge transistor including a first electrode configured to receive the k-th gate signal, a second electrode configured to receive the first ground voltage, and a control electrode configured to receive the inversion clock signal, a fourth discharge transistor including a first electrode configured to receive the k-th gate signal, a second electrode configured to receive the first ground voltage, and a control electrode configured to receive the (k+1)th carry signal, and a fifth discharge transistor including a first electrode connected to the first node, a second electrode configured to receive the second ground voltage, and a control electrode configured to receive the (k+1)th carry signal.

The second discharge unit may further include a sixth discharge transistor including a first electrode configured to receive the k-th carry signal, a second electrode configured to receive the second ground voltage, and a control electrode configured to receive the Inversion clock signal.

The discharge signal may include an Inversion clock signal complementary to the (k+1)th carry signal, a (k+2)th carry signal, and the clock signal.

The second discharge unit may include a second discharge transistor including a first electrode configured to receive the k-th carry signal, a second electrode configured to receive the second ground voltage, and a control electrode configured to receive the (k+1)th carry signal.

The second discharge unit may include a seventh discharge transistor including a first electrode connected to the first node, a second electrode configured to receive the second ground voltage, and a control electrode configured to receive the (k+2)th carry signal.

Another embodiment of the inventive concept provides a display device including a display panel including a plurality of pixels for displaying an image, a plurality of gate lines for receiving gate signals for driving the plurality of pixels, and a plurality of data lines for receiving data signals, a gate driving circuit on the display panel and configured to supply the gate signals to the plurality of gate lines, and a data driving circuit configured to supply the data signals to the plurality of data lines, wherein the gate driving circuit includes driving stages for providing the gate signals to the gate lines, and wherein a k-th driving stage (k being a natural number of two or more) among the driving stages includes a gate output unit configured to output a clock signal as a k-th gate signal in response to a voltage of a first node, a carry output unit configured to output the clock signal as a k-th carry signal in response to the voltage of the first node, a control unit configured to control a voltage level of the first node in response to a (k−1)th carry signal, a first discharge unit configured to discharge the k-th carry signal to a voltage level in response to the (k−1)th carry signal, and a second discharge unit configured to discharge the k-th carry signal to a voltage level in response to the (k+1)th carry signal.

The second discharge unit may be further configured to discharge the first node and the k-th gate signal to the voltage level in response to the (k+1)th carry signal.

The second discharge unit may be configured to discharge the k-th gate signal to a first ground voltage, and is configured to discharge the k-th carry signal and the first node to a second ground voltage, the first discharge unit may be configured to discharge the k-th carry signal to the first ground voltage, and the first ground voltage and the second ground voltage may include different voltage levels.

The second discharge unit may include a second discharge transistor including a first electrode configured to receive the k-th carry signal, a second electrode configured to receive the second ground voltage, and a control electrode configured to receive the (k+1)th carry signal.

BRIEF DESCRIPTION OF THE DRAWINGS

The accompanying drawings are included to provide a further understanding of the inventive concept, and are incorporated in, and constitute a part of, this specification. The drawings illustrate exemplary embodiments of the inventive concept and, together with the description, serve to explain principles of the inventive concept in the drawings.

DETAILED DESCRIPTION

Figure 1:
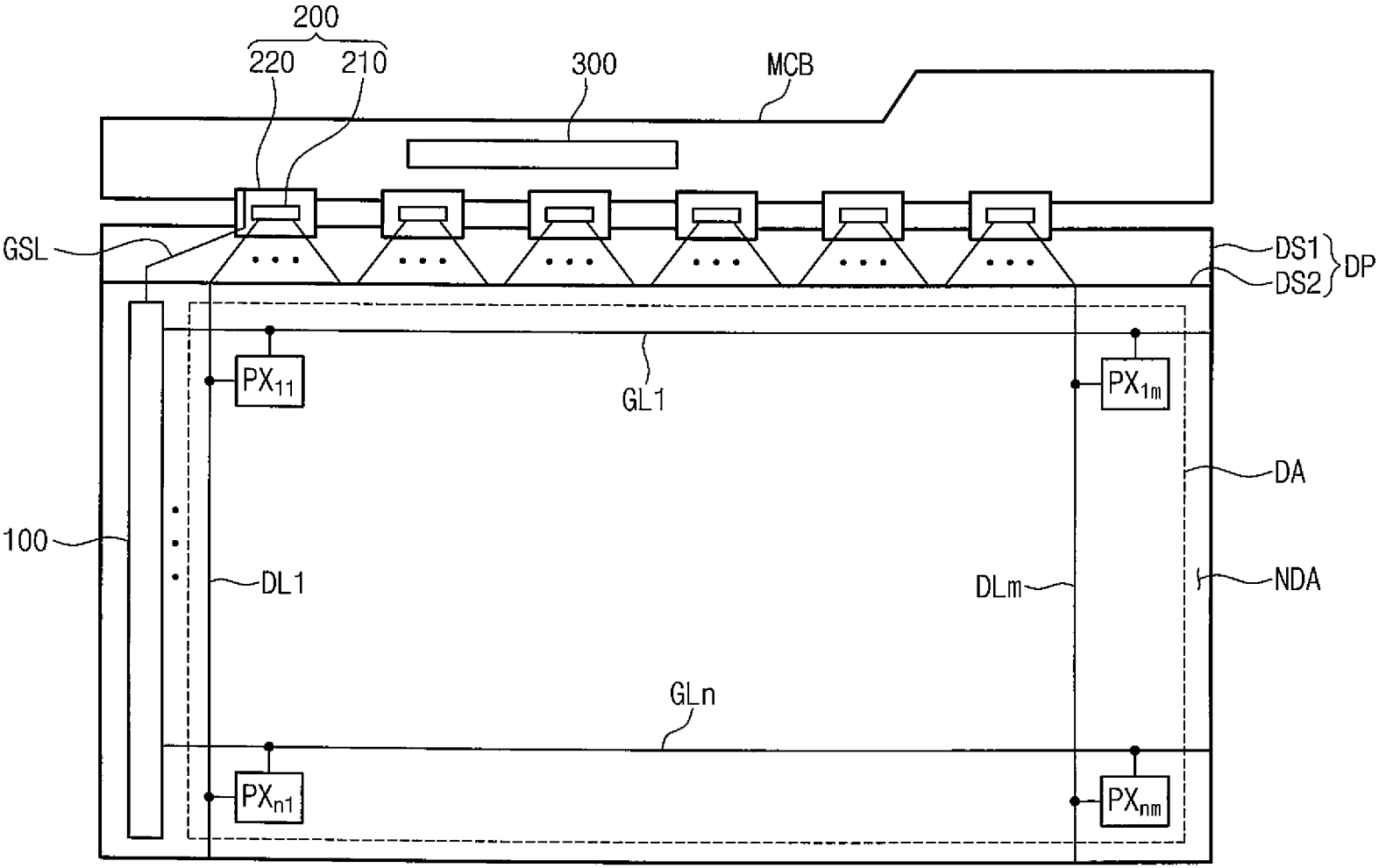
FIG. 1 is a plan view of a display device according to an embodiment of the inventive concept.

Features of the inventive concept and methods of accomplishing the same may be understood more readily by reference to the following detailed description of embodiments and the accompanying drawings. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present in addition, it will also be understood that when an element or layer is referred to as being "between" two elements or layers, it can be the only element or layer between the two elements or layers, or one or more intervening elements or layers may also be present.

In the following examples, the x-axis, the y-axis and the z-axis are not limited to three axes of a rectangular coordinate system, and may be interpreted in a broader sense. For example, the x-axis, the y-axis, and the z-axis may be perpendicular to one another, or may represent different directions that are not perpendicular to one another.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the Individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or Illustration.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
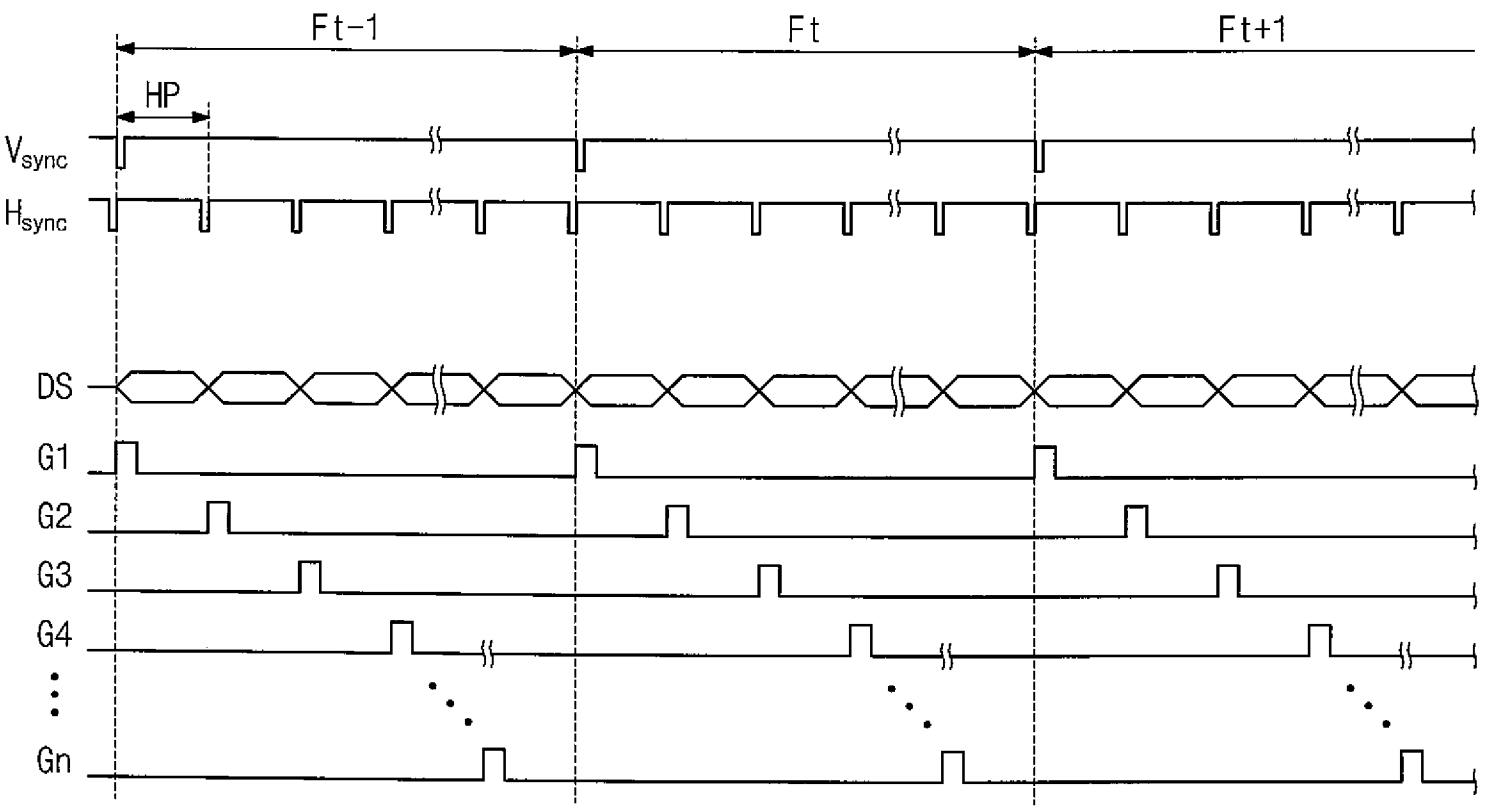
FIG. 2 is a timing diagram illustrating signals of a display device according to an embodiment of the inventive concept.

FIG. 1 is a plan view of a display device according to an embodiment of the Inventive concept, and FIG. 2 is a timing diagram illustrating signals of a display device according to an embodiment of the inventive concept.

As shown in FIGS. 1 and 2, a display device according to an embodiment of the inventive concept includes a display panel DP, a gate driving circuit 100, a data driving circuit 200, and a driving controller 300.

The display panel DP is not particularly limited and, for example, may include various display panels, such as a liquid crystal display panel, an organic light emitting display panel, an electrophoretic display panel, or an electrowetting display panel. In the present embodiment, the display panel DP is described as a liquid crystal display panel. Further, a liquid crystal display device including the liquid crystal display panel may also include a polarizer and a backlight unit.

The display panel DP includes a first substrate DS1, a second substrate DS2 spaced from the first substrate DS1, and a liquid crystal layer LCL (e.g., see FIG. 4) between the first substrate DS1 and the second substrate DS2. On a plane, the display panel DP includes a display area DA where a plurality of pixels PX11 to PXnm, and Includes a non-display area NDA surrounding the display area DA.

The display panel DP includes a plurality of gate lines GL1 to GLn on the first substrate DS1, and a plurality of data lines DL1 to DLm intersecting the plurality of gate lines GL1 to GLn. The plurality of gate lines GL1 to GLn are connected to the gate driving circuit 100. The plurality of data lines DL1 to DLm are connected to the data driving circuit 200. Only some of the plurality of gate lines GL1 to GLn and some of the plurality of data lines DL1 to DLm are illustrated in FIG. 1.

Only some of the plurality of pixels PX11 to PXnm are illustrated in FIG. 1. The plurality of pixels PX11 to PXnm are respectively connected to corresponding gate lines among the plurality of gate lines GL1 to GLn, and to corresponding data lines among the plurality of data lines DL1 to DLm.

For example, the plurality of pixels PX11 to PXnm may be divided into a plurality of groups according to a color displayed, and the plurality of pixels PX11 to PXnm may display one of primary colors. The primary colors may include red, green, blue, and white. However, the inventive concept is not limited thereto, and thus the primary colors may further include various colors, such as yellow, cyan, magenta, and so on.

The gate driving circuit 100 and the data driving circuit 200 receive a control signal from the driving controller 300. The driving controller 300 may be mounted on a main circuit board MCB. The driving controller 300 may receive image data and control signals from an external graphic control unit. The control signals may include vertical sync signals Vsync, which are signals for distinguishing frame sections Ft−1, Ft, and Ft+1, horizontal sync signals Hsync, which are signals for distinguishing horizontal sections HP (i.e., row distinction signals), data enable signals, which have a high level only during a section where data is output to display a data incoming area, and clock signals.

The gate driving circuit 100 generates gate signals G1 to Gn on the basis of a control signal (hereinafter referred to as a gate control signal) received from the driving controller 300 through a signal line GSL, and outputs the gate signals G1 to Gn to the plurality of gate lines GL1 to GLn during the frame sections Ft−1, Ft, and Ft+1. The gate signals G1 to Gn may be sequentially output corresponding to the horizontal sections HP. The gate driving circuit 100 and the pixels PX11 to PXnm may be formed simultaneously through a thin film process. For example, the gate driving circuit 100 may be mounted as an Oxide Semiconductor TFT Gate (OSG) driver circuit in the non-display area NDA.

FIG. 1 illustrates one gate driving circuit 100 connected to the left ends of the plurality of gate lines GL1 to GLn. According to an embodiment of the inventive concept, a display device may include two gate driving circuits. One of the two gate driving circuits may be connected to left ends of some or all of the plurality of gate lines GL1 to GLn and the other one may be connected to right ends of some or all of the plurality of gate lines GL1 to GLn. Additionally, one of the two gate driving circuits may be connected to odd gate lines, and the other one may be connected to even gate lines.

The data driving circuit 200 generates grayscale voltages according to image data provided from the driving controller 300 on the basis of a control signal (hereinafter referred to as a data control signal) received from the driving controller 300. The data driving circuit 200 outputs the grayscale voltages as data voltages DS to the plurality of data lines DL1 to DLm.

The data voltages DS may include positive data voltages having a positive value with respect to a common voltage, and/or negative data voltages having a negative value with respect to the common voltage. Some of data voltages applied to the data lines DL1 to DLm have a positive polarity, and others have a negative polarity, during each of the horizontal sections HP. The polarity of the data voltages DS may be inverted according to the frame sections Ft−1, Ft, and Ft+1 to prevent or reduce deterioration of a liquid crystal. The data driving circuit 200 may generate data voltages inverted for each frame section in response to an invert signal.

The data driving circuit 200 may include a driving chip 210 and a flexible circuit board 220 for mounting the driving chip 210. The data driving circuit 200 may include a plurality of driving chips 210 and the flexible circuit board(s) 220. The flexible circuit board 220 electrically connects the main circuit board MCB and the first substrate DS1. The plurality of driving chips 210 provide data signals to corresponding data lines among the plurality of data lines DL1 to DLm.

FIG. 1 exemplarily illustrates a Tape Carrier Package (TCP) type data driving circuit 200. According to another embodiment of the inventive concept, the data driving circuit 200 may be disposed at the non-display area NDA of the first substrate DS1 through a Chip on Glass (COG) method.

Figure 3:
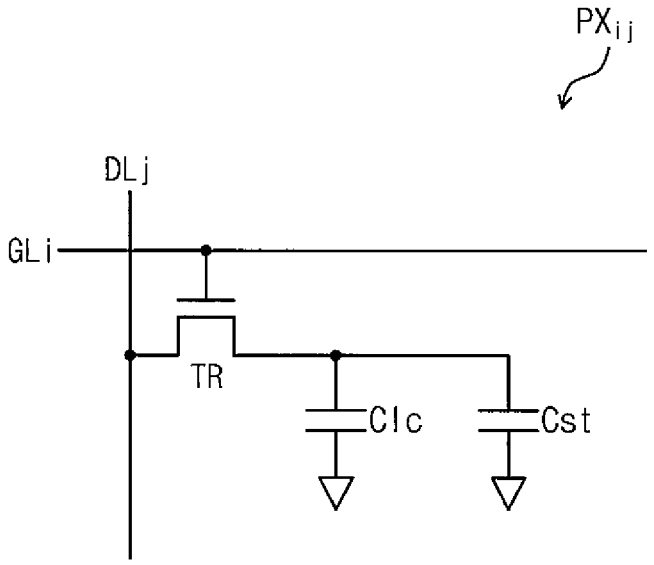
FIG. 3 is an equivalent circuit diagram of a pixel according to an embodiment of the inventive concept.
Figure 4:
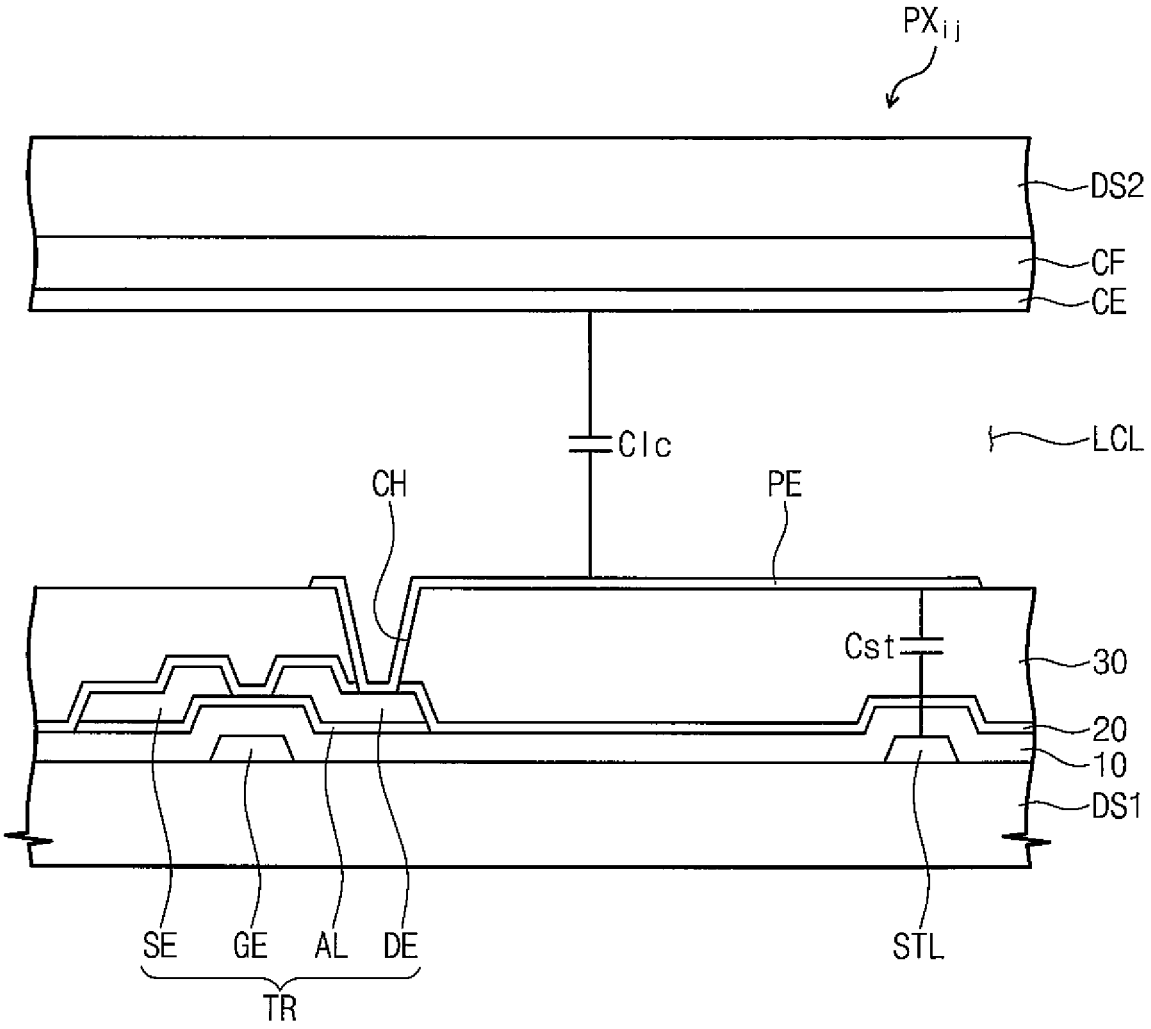
FIG. 4 is a sectional view of a pixel according to an embodiment of the inventive concept.

FIG. 3 is an equivalent circuit diagram of a pixel according to an embodiment of the inventive concept, and FIG. 4 is a sectional view of a pixel according to an embodiment of the inventive concept. Each of the plurality of pixels PX11 to PXnm shown in FIG. 1 may have an equivalent circuit shown in FIG. 3.

As shown in FIG. 3, the pixel PXij includes a pixel thin film transistor (hereinafter referred to as a pixel transistor) TR, a liquid crystal capacitor Clc, and a storage capacitor Cst. Hereinafter, in the specification, a transistor refers to a thin film transistor. According to an embodiment of the Inventive concept, the storage capacitor Cst may be omitted.

The pixel transistor TR is electrically connected to an I-th gate line GLi and a j-th data line DLj. The pixel transistor TR outputs a pixel voltage corresponding to a data signal received from the j-th data line DLj in response to a gate signal received from the i-th gate line GLi.

The liquid crystal capacitor Clc is charged with a pixel voltage output from the pixel transistor TR. An arrangement of liquid crystal directors included in a liquid crystal layer LCL (see FIG. 4) is changed according to a charge amount that is charged in the liquid crystal capacitor Clc. The light incident to the liquid crystal layer LCL may be transmitted or blocked according to an arrangement of the liquid crystal directors.

The storage capacitor Cst is connected in parallel to the liquid crystal capacitor Clc. The storage capacitor Cst maintains an arrangement of liquid crystal directors during a predetermined section.

As shown in FIG. 4, the pixel transistor TR includes a control electrode GE connected to the i-th gate line GU (see FIG. 3), an activation part AL overlapping the control electrode GE, a first electrode SE connected to the j-th data line DLj (see FIG. 3), and a second electrode DE spaced from the first electrode SE.

The liquid crystal capacitor Clc includes a pixel electrode PE and a common electrode CE. The storage capacitor Cst includes the pixel electrode PE, and a portion of a storage line STL overlapping the pixel electrode PE.

The i-th gate line GLi and the storage line STL are on one surface of the first substrate DS1. The control electrode GE is branched from the i-th gate line GLi. The i-th gate line GLi and the storage line STL may include a metal (for example, Al, Ag, Cu, Mo, Cr, Ta, Ti, and so on) and/or an alloy thereof. The i-th gate line GLi and the storage line STL may have a multilayer structure, and for example, may include a Ti layer and/or a Cu layer.

A first insulating layer 10 covering the control electrode GE and the storage line STL is on one surface of the first substrate DS1. The first insulating layer 10 may include at least one of an Inorganic material and an organic material. The first insulating layer 10 may be an organic layer and/or an inorganic layer. The first insulating layer 10 may have a multilayer structure and, for example, may include a silicon nitride layer and/or a silicon oxide layer.

The activation part AL overlapping the control electrode GE is on the first insulating layer 10. The activation part AL may include a semiconductor layer and an ohmic contact layer. The semiconductor layer is disposed on the first insulating layer 10, and the ohmic contact layer is disposed on the semiconductor layer.

The second electrode DE and the first electrode SE are on, or above, the activation part AL. The second electrode DE and the first electrode SE are spaced from each other. Each of the second electrode DE and the first electrode SE partially overlaps the control electrode GE.

A second insulating layer 20 that covers the activation part AL, the second electrode DE, and the first electrode SE, is on the first insulating layer 10. The second insulating layer 20 may include at least one of an inorganic material and/or an organic material. The second insulating layer 20 may be an organic layer and/or an inorganic layer. The second insulating layer 20 may have a multilayer structure and, for example, may include a silicon nitride layer and/or a silicon oxide layer.

Although the pixel transistor TR having a staggered structure is exemplarily shown in FIG. 4, a structure of the pixel transistor TR is not limited thereto. The pixel transistor TR may have a planar structure.

A third insulating layer 30 is disposed on the second insulating layer 20. The third insulating layer 30 provides a flat surface. The third insulating layer 30 may include an organic material.

The pixel electrode PE is on the third insulating layer 30. The pixel electrode PE is connected to the second electrode DE of the pixel transistor TR through a contact hole CH penetrating the second insulating layer 20 and the third insulating layer 30. An alignment layer covering the pixel electrode PE may be on the third insulating layer 30, in other embodiments.

A color filter layer CF is on/below one surface of the second substrate DS2. A common electrode CE is on/below the color filter layer CF. A common voltage is applied to the common electrode CE. A common voltage and a pixel voltage have different values. An alignment layer covering the common electrode CE may be on/below the common electrode CE. Another insulating layer may be between the color filter layer CF and the common electrode CE.

The pixel electrode PE, the common electrode CE and the liquid crystal layer LCL therebetween collectively form the liquid crystal capacitor Clc. Additionally, portions of the pixel electrode PE and the storage line STL, which have the first insulating layer 10, the second insulating layer 20, and the third insulating layer 30 therebetween, collectively form the storage capacitor Cst. The storage line STL receives a storage voltage having a different value than the pixel voltage. The storage voltage may have the same value as the common voltage.

On the other hand, a section of the pixel PXij shown in FIG. 3 is just one example. Unlike FIG. 3, in other embodiments, at least one of the color filter layer CF and the common electrode CE may be on the first substrate DS1. That is, a liquid crystal display panel according to the present embodiment may include a pixel in a Vertical Alignment (VA) mode, a Patterned Vertical Alignment (PVA) mode, an in-plane switching (IPS) mode, a fringe-field switching (FFS) mode, or a Plane-to-Line Switching (PLS) mode.

Figure 5:
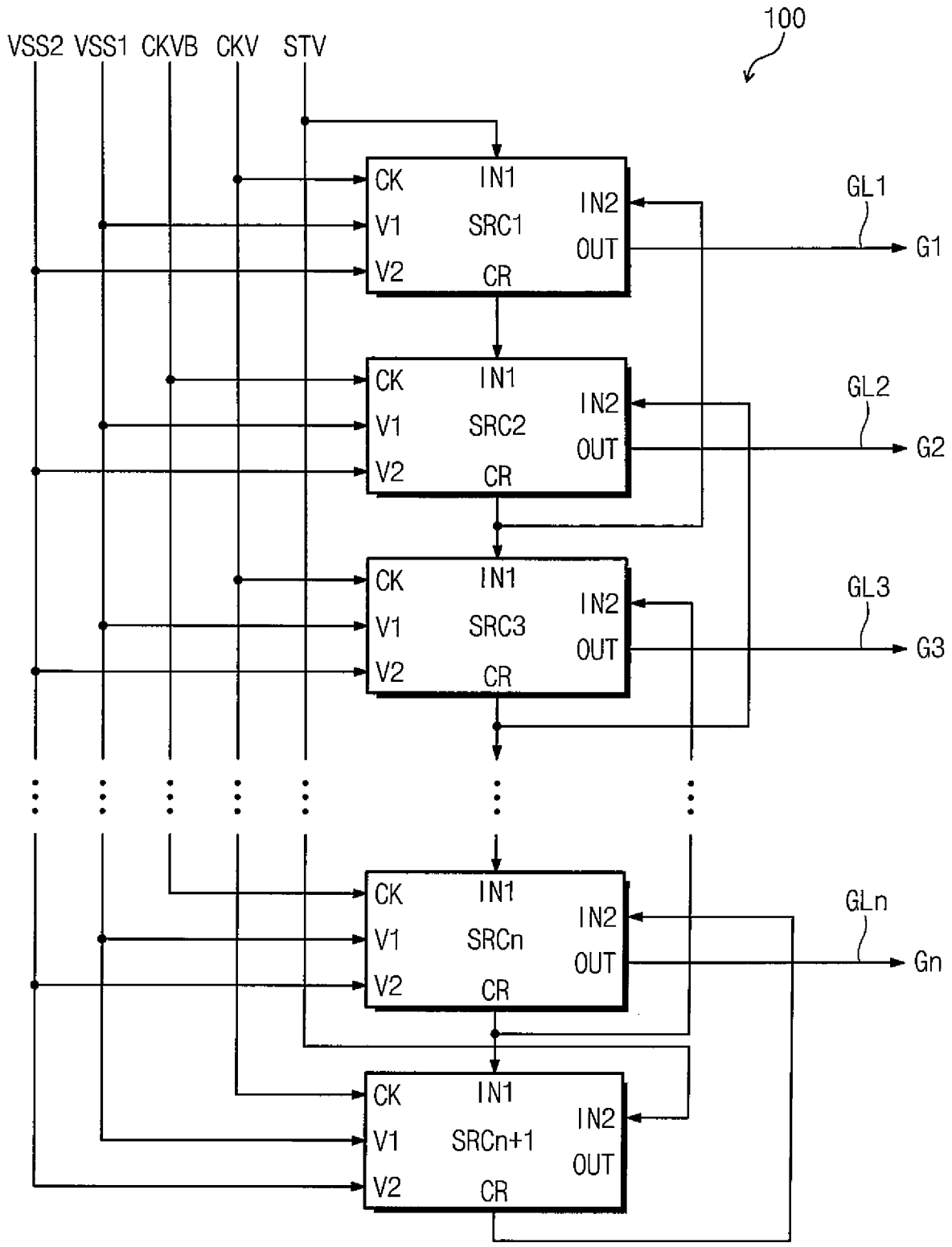
FIG. 5 is a block diagram illustrating a gate driving circuit according to an embodiment of the Inventive concept.

FIG. 5 is a block diagram illustrating a gate driving circuit according to an embodiment of the inventive concept.

As shown in FIG. 5, a gate driving circuit 100 includes a plurality of driving stages SRC1 to SRCn and a dummy driving stage SRCn+1. The plurality of driving stages SRC1 to SRCn and the dummy driving stage SRCn+1 have a cascade relationship, whereby they operate in response to a carry signal output from a previous stage, and in response to a carry signal output from the next stage.

Each of the plurality of driving stages SRC1 to SRCn receives (e.g., from the driving controller 300 shown in FIG. 1) a first clock signal CKV or a second clock signal (e.g., an inversion clock signal) CKVB, a first ground voltage VSS1, and a second ground voltage VSS2. The driving stage SRC1 and the dummy driving stage SRCn+1 also receive a vertical start signal STV.

According to the present embodiment, the plurality of driving stages SRC1 to SRCn are respectively connected to the plurality of gate lines GL1 to GLn. The plurality of driving stages SRC1 to SRCn respectively provide gate signals G1 to Gn to the plurality of gate lines GL1 to GLn. According to an embodiment of the inventive concept, gate lines connected to the plurality of driving stages SRC1 to SRCn may be odd gate lines or even gate lines among an entirety of the gate lines GL1 to GLn.

Each of the plurality of driving stages SRC1 to SRCn and the dummy driving stage SRCn+1 Includes input terminals IN1 and IN2, an output terminal OUT, a carry terminal CR, a clock terminal CK, a first ground terminal V1, and a second ground terminal V2.

The output terminal OUT of each of the plurality of driving stages SRC1 to SRCn is connected to a corresponding gate line among the plurality of gate lines GL1 to GLn. The gate signals G1 to Gn respectively generated from the plurality of driving stages SRC1 to SRCn are provided to the plurality of gate lines GL1 to GLn through the respective output terminal OUT.

The carry terminal CR of each of the plurality of driving stages SRC1 to SRCn is electrically connected to the first input terminal IN1 of the next, or subsequent, driving stage, and is electrically connected to the second input terminal IN2 of a previous driving stage. For example, the carry terminal CR of the k-th driving stage SRCk among the driving stages SRC1 to SRCn is connected to the first input terminal IN1 of the (k+1)th driving stage SRCk+1, and is connected the second input terminal IN2 of the (k−1)th driving stage SRCk−1. The carry terminal CR of each of the plurality of driving stages SRC1 to SRCn and of the dummy driving stage SRCn+1 outputs a carry signal.

The first input terminal IN1 of each of the plurality of driving stages SRC2 to SRCn and of the dummy driving stage SRCn+1 receives a carry signal of a corresponding previous driving stage. For example, the first input terminal IN1 of the k-th driving stage SRCk receives the carry signal of the (k−1)th driving stage SRCk−1. The first input terminal IN1 of the first driving stage SRC1, however, receives a vertical start signal STV for starting the drive of the gate driving circuit 100 instead of the carry signal of a previous driving stage.

The second input terminal IN2 of each of the plurality of driving stages SRC1 to SRCn receives a carry signal from the carry terminal CR of the next driving stage of a corresponding driving stage. For example, the second input terminal IN2 of the k-th driving stage SRCk receives a carry signal output from the carry terminal CR of the (k+1)th driving stage SRCk+1. According to another embodiment of the inventive concept, the second input terminal IN2 of each of the plurality of driving stages SRC1 to SRCn may be electrically connected to the output terminal OUT of a corresponding next/subsequent driving stage.

The second input terminal IN2 of the driving stage SRCn at the end of the plurality of driving stages receives a carry signal output from the carry terminal CR of the dummy stage SRCn+1. The second input terminal IN2 of the dummy driving stage SRCn+1 receives a vertical start signal STV.

The clock terminal CK of each of the plurality of driving stages SRC1 to SRCn receives the first clock signal CKV or the second clock signal CKVB. For example, if a total number of the driving stages SRC1 to SRCn is an even number, each of the clock terminals CK of the odd driving stages SRC1, SRC3, . . . , SRCn−1 may receive the first clock signal CKV, while each of the clock terminals CK of the even driving stages SRC2, SRC4, . . . , SRCn may receive the second clock signal CKVB. The first clock signal CKV and the second clock signal CKVB may have different, or opposite, phases.

Figure 6:
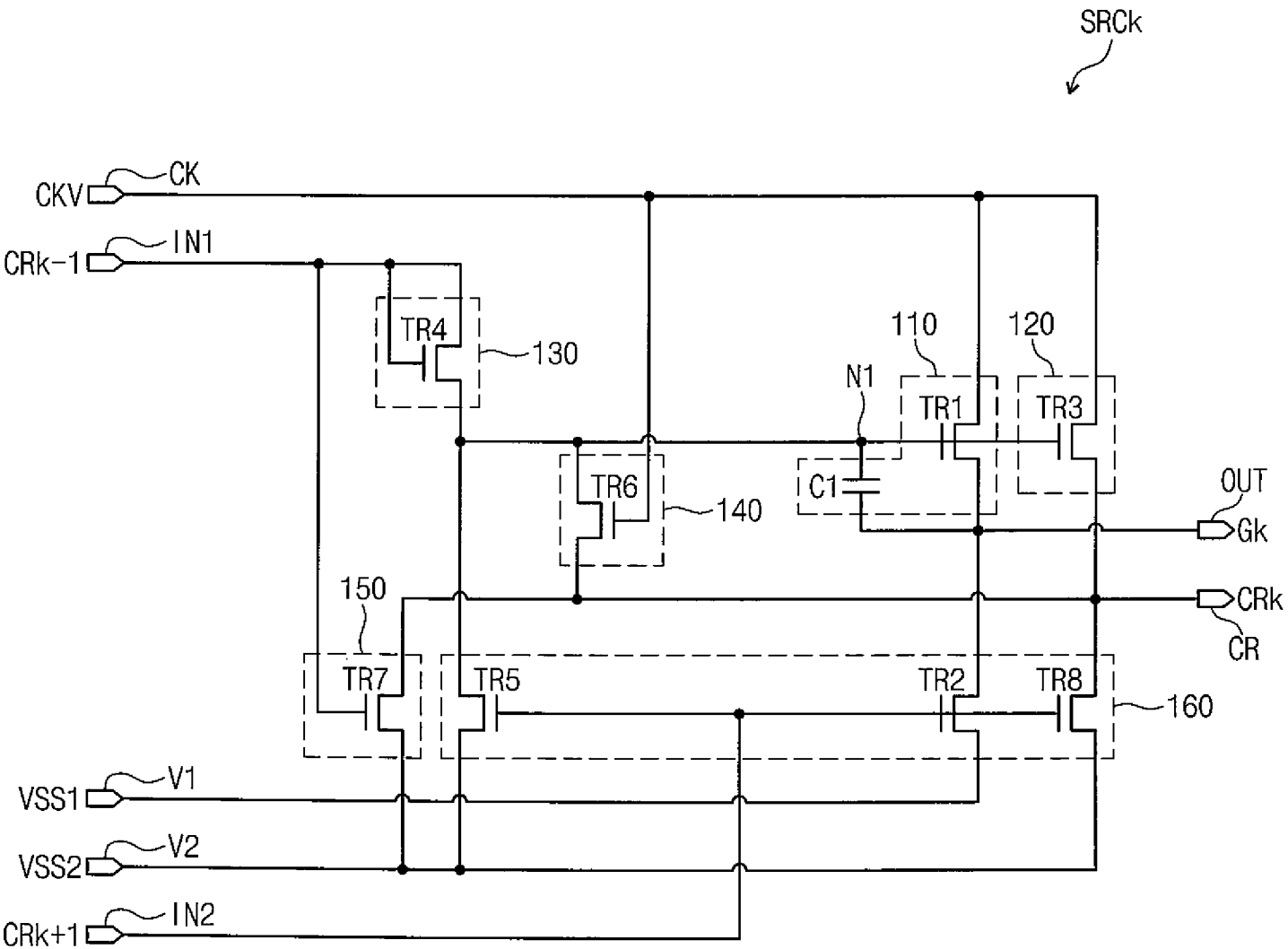
FIG. 6 is a circuit diagram of a driving stage according to an embodiment of the inventive concept.

The first ground terminal V1 of each of the plurality of driving stages SRC1 to SRCn receives a first ground voltage VSS1 (e.g., see FIG. 6). The second ground terminal V2 of each of the plurality of driving stages SRC1 to SRCn receives a second ground voltage VSS2 (e.g., see FIG. 6). The first ground voltage VSS1 and the second ground voltage VSS2 have different voltage levels, and the second ground voltage VSS2 has a lower voltage level than the first ground voltage VSS1.

According to an embodiment of the Inventive concept, according to a circuit configuration, each of the plurality of driving stages SRC1 to SRCn may omit one of the output terminal OUT, the first input terminal IN1, the second input terminal IN2, the carry terminal CR, the clock terminal CK, the first ground terminal V1, or the second ground terminal V2, or may further include other terminals. For example, the first ground terminal V1 or the second ground terminal V2 may be omitted, in which case each of the plurality of driving stages SRC1 to SRCn receives only one of the first ground voltage VSS1 and the second ground voltage VSS2. Additionally, the connection relationship of the plurality of driving stages SRC1 to SRCn may be changed.

FIG. 6 is a circuit diagram of a driving stage according to an embodiment of the Inventive concept.

FIG. 6 illustrates the k-th driving stage SRCk (k is a positive integer) among the plurality of driving stages SRC1 to SRCn shown in FIG. 5. Each of the plurality of driving stages SRC1 to SRCn and the dummy driving stage SRCn+1 shown in FIG. 5 may have the same circuit structure as the k-th driving stage SRCk.

Referring to FIG. 6, the k-th driving stage SRCk includes a gate output unit 110, a carry output unit 120, a control unit 130, a glitch prevention unit 140, a first discharge unit 150, and a second discharge unit 160.

The gate output unit 110 outputs a clock signal CKV, which is input to the clock terminal CK, as the k-th gate signal Gk in response to a voltage of a first node N1. The carry output unit 120 outputs a clock signal CKV as the k-th carry signal CRk in response to a voltage of the first node N1. The control unit 130 controls a voltage level of the first node N1 in response to the (k−1)th carry signal CRk−1 that is input through the first input terminal IN1. The first discharge unit 150 discharges the k-th carry signal CRk to a ground voltage level in response to the (k−1)th carry signal CRk−1. The second discharge unit 160 discharges the k-th carry signal CRk to the ground voltage level in response to a discharge signal, which may include a (k+1)th carry signal CRk+1 received through the second input terminal IN2. The ground voltage level may include a first ground voltage VSS1 of a first ground terminal V1 and/or a second ground voltage VSS2 of a second ground terminal V2. The second discharge unit 160 may discharge the k-th gate signal Gk and the first node N1, in addition to the k-th carry signal CRk, to a ground voltage level.

A specific configuration of the k-th driving stage SRCk is as follows.

The gate output unit 110 includes a first output transistor TR1 and a capacitor C1. The first output transistor TR1 includes a first electrode connected to the clock terminal CK, a control electrode connected to the first node N1, and a second electrode for outputting the k-th gate signal Gk.

The carry output unit 120 includes a second output transistor TR3. The second output transistor TR3 includes a first electrode connected to the clock terminal CK, a control electrode connected to the first node N1, and a second electrode for outputting the k-th carry signal CRk.

The control unit 130 includes a control transistor TR4. The control transistor TR4 includes a first electrode connected to the first input terminal IN1, a control electrode connected to the first input terminal IN1, and a second electrode connected to the first node N1.

The glitch prevention unit 140 includes a transistor TR6, which includes a first electrode connected to the first node N1, a control electrode connected to the clock terminal CK, and a second electrode connected to the carry terminal CR to receive the k-th carry signal CRk.

The first discharge unit 150 includes a first discharge transistor TR7, which includes a first electrode connected to the carry terminal CR to receive the k-th carry signal CRk, a control electrode connected to the first input terminal IN1 to receive the (k−1)th carry signal CRk−1, and a second electrode connected to the second ground terminal V2 to receive the second ground voltage VSS2.

The second discharge unit 160 includes second to fourth discharge transistors TR8, TR2, and TR5. The second discharge transistor TR8 includes a first electrode connected to the carry terminal CR to receive the k-th carry signal CRk, a control electrode connected to the second input terminal IN2 to receive the (k+1)th carry signal CRk+1, and a second electrode connected to the second ground terminal V2 to receive the second ground voltage VSS2. The third discharge transistor TR2 includes a first electrode connected to the carry terminal CR to receive the k-th carry signal CRk, a control electrode connected to the second input terminal IN2 to receive the (k+1)th carry signal CRk+1, and a second electrode connected to the first ground terminal V1. The fourth discharge transistor TR5 includes a first electrode connected to the first node N1, a control electrode connected to the second input terminal IN2 to receive the (k+1)th carry signal CRk+1, and a second electrode connected to the second ground terminal V2 to receive the second ground voltage VSS2.

Figure 7:
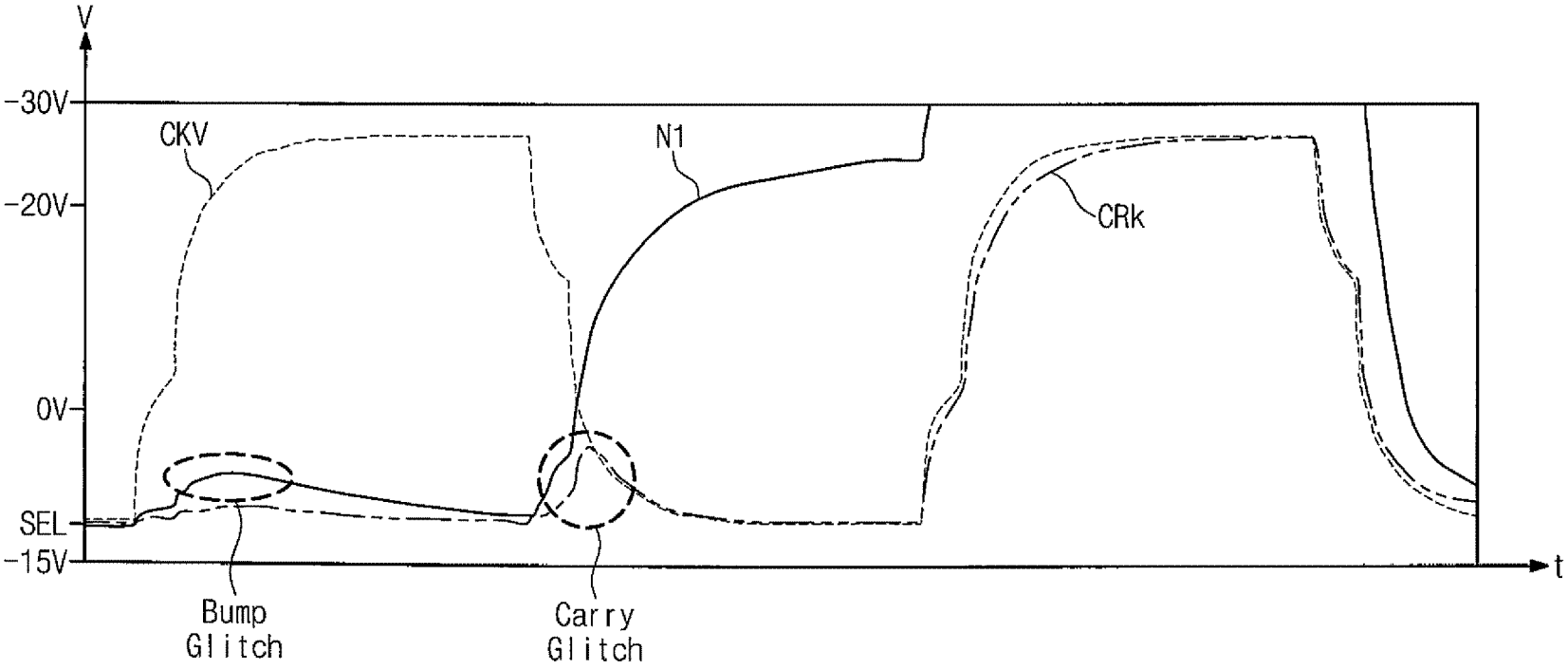
FIG. 7 is a view illustrating a signal waveform according to an operation of the driving stage shown in FIG. 6.

FIG. 7 is a view illustrating a signal waveform according to an operation of the driving stage SRCk shown in FIG. 6.

Referring to FIGS. 6 and 7, the first discharge unit 150 discharges the k-th carry signal CRk to the second ground voltage VSS2 in response to the (k−1)th carry signal CRk−1. As the clock signal CKV transitions from a high level to a low level, and as the (k−1)th carry signal CRk−1 transitions from a low level to a high level, when the first node N1 is pre-charged, carry glitch noise, in which a voltage level of the k-th carry signal CRk rises, may temporarily occur. That is, before the transistor T6 completely transitions to an off state, a voltage level of the k-th carry signal CRk may rise to a voltage level of the first node N1. When the (k−1)th carry signal CRk−1 transitions to a high level, if the first discharge transistor TR5 is turned on, the glitch noise of the k-th carry signal CRk may be reduced or prevented.

The k-th carry signal CRk of the k-th driving stage SRCk is provided to the (k+1)th driving stage SRCk+1. When the control transistor TR4 in the (k+1)th driving stage SRCk+1 is turned on, the k-th carry signal CRk of the k-th driving stage SRCk may rise to a voltage level of the first node N1 in the (k+1)th driving stage SRCk+1 in a pre-charge section of the first node N1 in the (k+1)th driving stage SRCk+1. The second discharge transistor TR8 in the second discharge unit 160 may discharge the k-th carry signal CRk to the second ground voltage VSS2 in response to the (k+1)th carry signal CRk+1. Therefore, the k-th driving stage SRCk may output the k-th carry signal CRk in a stable level.

Moreover, when the above-mentioned carry glitch noise occurs in the (k−1)th carry signal CRk−1, as the control transistor TR4 is turned on, bump glitch noise (e.g., overshoot), wherein a voltage level of the first node N1 rises, may occur. The transistor TR6 discharges a voltage level of the first node N1 to the k-th carry signal CRk in accordance with the clock signal CLK. Therefore, the bump glitch noise of the first node N1 may be reduced or prevented.

Especially, while the clock signal CKV is in a high level and the k-th carry signal CRk is in a high level, the first node N1 in the k-th driving stage SRCk may be connected to the first node N1 of the (k+1)th driving stage SRCk+1 through the control transistor TR4 of the (k+1)th driving stage SRCk+1. In such a manner, as the first node N1 in the k-th driving stage SRCk is electrically connected to the first node N1 in the (k+1)th driving stage SRCk+1, the ripples of the first nodes N1 in the driving stages SRC1 to SRCn may cancel each other.

Figure 8:
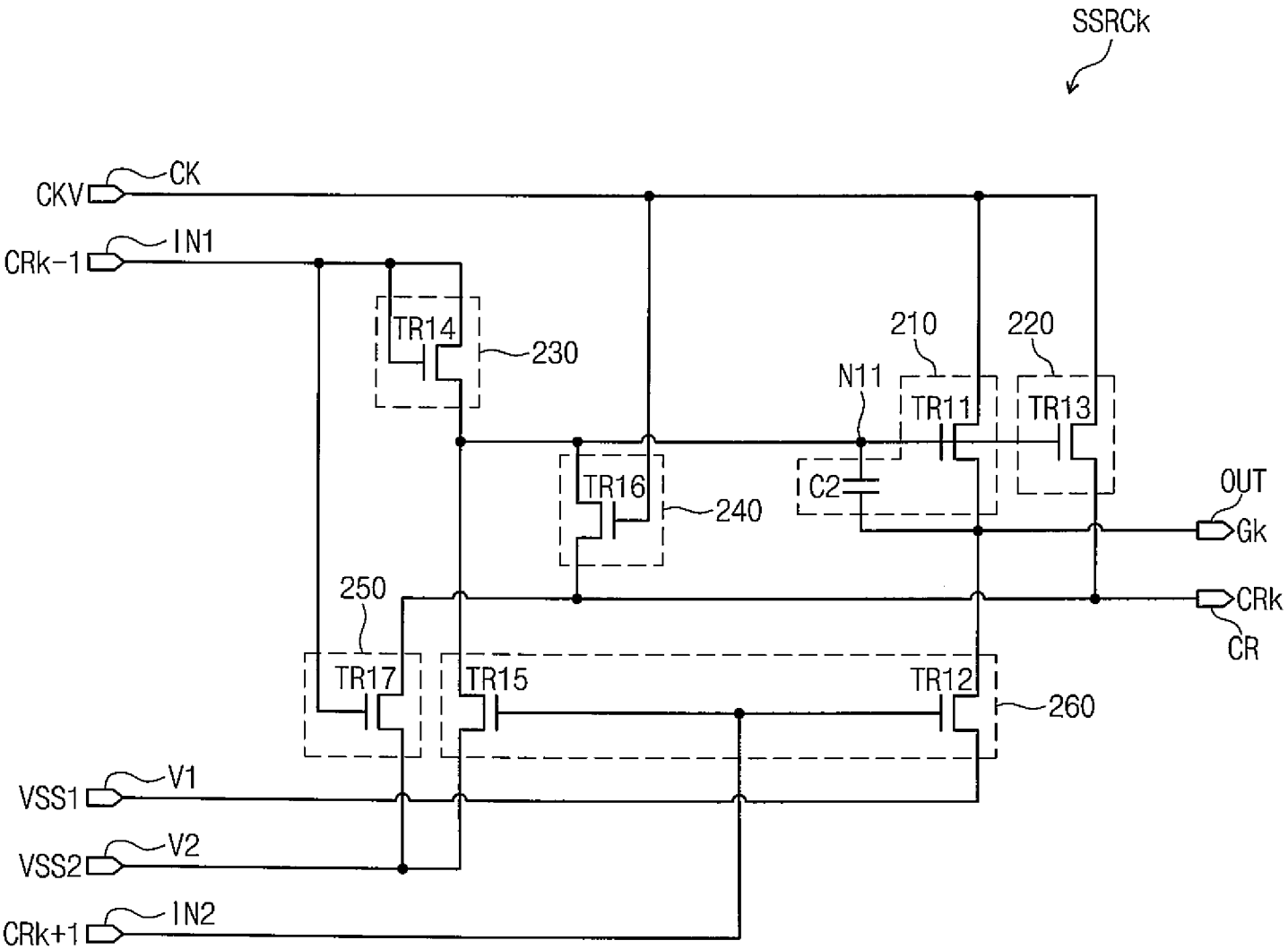
FIG. 8 is a circuit diagram of a driving stage according to another embodiment of the Inventive concept.

FIG. 8 is a circuit diagram of a driving stage according to another embodiment of the inventive concept.

FIG. 8 illustrates a driving stage SSRCk that is another example of the k-th driving stage SRCk (k is a positive integer) among the plurality of driving stages SRC1 to SRCn shown in FIG. 5. Each of the plurality of driving stages SRC1 to SRCn and the dummy driving stage SRCn+1 shown in FIG. 5 may have the same circuit as the k-th driving stage SSRCk.

Referring to FIG. 8, the k-th driving stage SSRCk includes a gate output unit 210, a carry output unit 220, a control unit 230, a glitch prevention unit 240, a first discharge unit 250, and a second discharge unit 260.

The gate output unit 210 outputs a clock signal CKV, which is input to the clock terminal CK, as the k-th gate signal Gk in response to a voltage of a first node N11. The carry output unit 220 outputs the clock signal CKV as the k-th carry signal CRk in response to the voltage of the first node N11. The control unit 230 controls a voltage level of the first node N11 in response to the (k−1)th carry signal CRk−1 input through the first input terminal IN1. The first discharge unit 250 discharges the k-th carry signal CRk to the second ground voltage VSS2 in response to the (k−1)th carry signal CRk−1. The second discharge unit 260 discharges the k-th gate signal CRk to the first ground voltage VSS1, and also discharges the first node N11 to the second ground voltage VSS2, in response to the (k+1)th carry signal CRk+1.

Unlike the second discharge unit 160 of the k-th driving stage SRCk shown in FIG. 6, the second discharge unit 260 of the k-th driving stage SSRCk shown in FIG. 8 does not include the second discharge transistor TR8. By reducing the number of transistors included in the k-th driving stage SSRCk, the area of the gate driving circuit 100 shown in FIG. 1 may be reduced.

Figure 9:
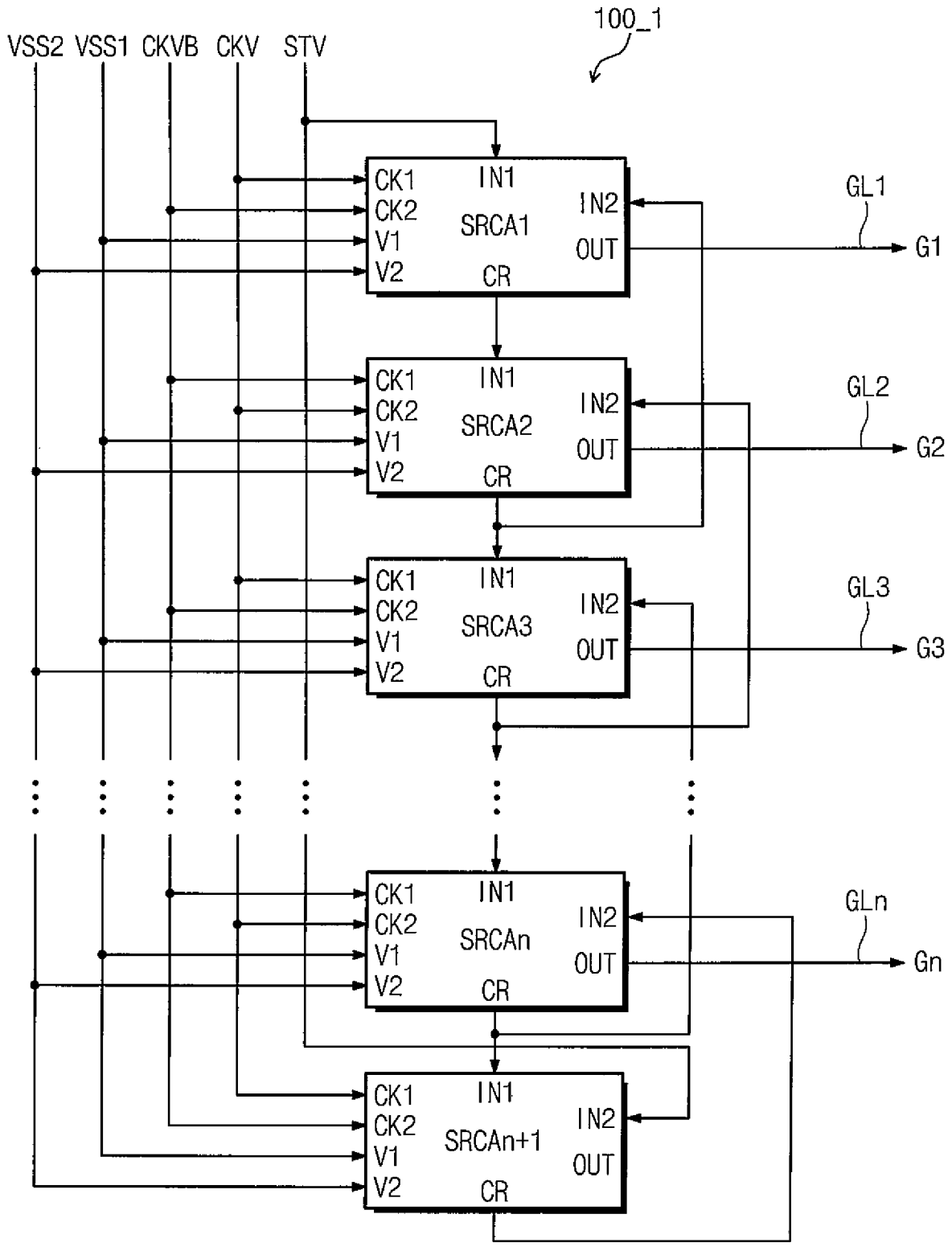
FIG. 9 is a block diagram illustrating a gate driving circuit according to another embodiment of the inventive concept.

FIG. 9 is a block diagram illustrating a gate driving circuit according to another embodiment of the inventive concept.

As shown in FIG. 9, a gate driving circuit 100_1 includes a plurality of driving stages SRCA1 to SRCAn and a dummy driving stage SRCAn+1. The plurality of driving stages SRCA1 to SRCAn and the dummy driving stage SRCAn+1 have a cascade relationship, whereby they operate in response to both a carry signal output from a previous stage and a carry signal output from the next stage.

Each of the plurality of driving stages SRCA1 to SRCAn receives a first clock signal CKV, a second clock signal CKVB, a first ground voltage VSS1, and a second ground voltage VSS2 from the driving controller 300 shown in FIG. 1. The driving stage SRCA1 and the dummy driving stage SRCAn+1 receive a vertical start signal STV. Contrastingly, although each of the plurality of driving stages SRC1 to SRCn and the dummy driving stage SRCn+1 shown in FIG. 5 receives only one of the first clock signal CKV and the second clock signal CKVB, each of the plurality of driving stages SRCA1 to SRCAn and the dummy driving stage SRCAn+1 shown in FIG. 9 receives both of the first clock signal CKV and the second clock signal CKVB.

The plurality of driving stages SRCA1 to SRCAn are respectively connected to the plurality of gate lines GL1 to GLn, and respectively provide gate signals G1 to Gn to the plurality of gate lines GL1 to GLn. Each of the plurality of driving stages SRCA1 to SRCAn and the dummy driving stage SRCAn+1 includes first and second input terminals IN1 and IN2, an output terminal OUT, a carry terminal CR, a first clock terminal CK1, a second clock terminal CK2, a first ground terminal V1, and a second ground terminal V2.

The output terminal OUT of each of the plurality of driving stages SRCA1 to SRCAn is connected to a corresponding gate line among the plurality of gate lines GL1 to GLn. The gate signals G1 to Gn respectively generated from the plurality of driving stages SRCA1 to SRCAs are provided to the plurality of gate lines GL1 to GLn through the output terminal OUT.

The carry terminal CR of each of the plurality of driving stages SRCA1 to SRCAn is electrically connected to the first input terminal IN1 of a corresponding next driving stage, and is electrically connected to the second input terminal IN2 of a corresponding previous driving stage. For example, the carry terminal CR of the k-th driving stage SRCAk among the driving stages SRCA1 to SRCAn is connected to the first input terminal IN1 of the (k+1)th driving stage SRCAk+1, and is connected to the second input terminal IN2 of the (k−1)th driving stage SRCAk−1. The carry terminal CR of each of the plurality of driving stages SRCA1 to SRCAn and the dummy driving stage SRCAn+1 outputs a carry signal.

The first input terminal IN1 of each of the plurality of driving stages SRCA2 to SRCAn and the dummy driving stage SRCAn+1 receives a carry signal of a corresponding previous driving stage. The second input terminal IN2 of each of the plurality of driving stages SRC1 to SRCn receives a carry signal from the carry terminal CR of a corresponding next driving stage. The second input terminal IN2 of the driving stage SRCAn at the end of the plurality of driving stages SRCA1 to SRCAn receives a carry signal that is output from the carry terminal CR of the dummy stage SRCAn+1. The second input terminal IN2 of the dummy driving stage SRCAn+1 receives a vertical start signal STV.

The first clock terminal CK1 and the second clock terminal CK2 of each of the plurality of driving stages SRCA1 to SRCAn receive the first clock signal CKV and the second clock signal CKVB, respectively. For example, the first clock terminal CK1 and the second clock terminal CK2 of each of the odd driving stages SRCA1, SRCA3, . . . , SRCAn−1 and the dummy driving stage SRCAn+1 receive the first clock signal CKV and the second clock signal CKVB, respectively. Contrastingly, the first clock terminal CK1 and the second clock terminal CK2 of each of the even driving stages SRCA2, SRCA4, . . . , SRCAn receives the second clock signal CKVB and the first clock signal CKV, respectively. The first clock signal CKV and the second clock signal CKVB may have different, or opposite, phases. The first clock signal CKV and the second clock signal CKVB may be pulse signals having a complementary level.

The first ground terminal V1 of each of the plurality of driving stages SRCA1 to SRCAn receives a first ground voltage VSS1. The second ground terminal V2 of each of the plurality of driving stages SRCA1 to SRCAn receives a second ground voltage VSS2. The first ground voltage VSS1 and the second ground voltage VSS2 have different voltage levels, and the second ground voltage VSS2 has a lower voltage level than the first ground voltage VSS1.

Figure 10:
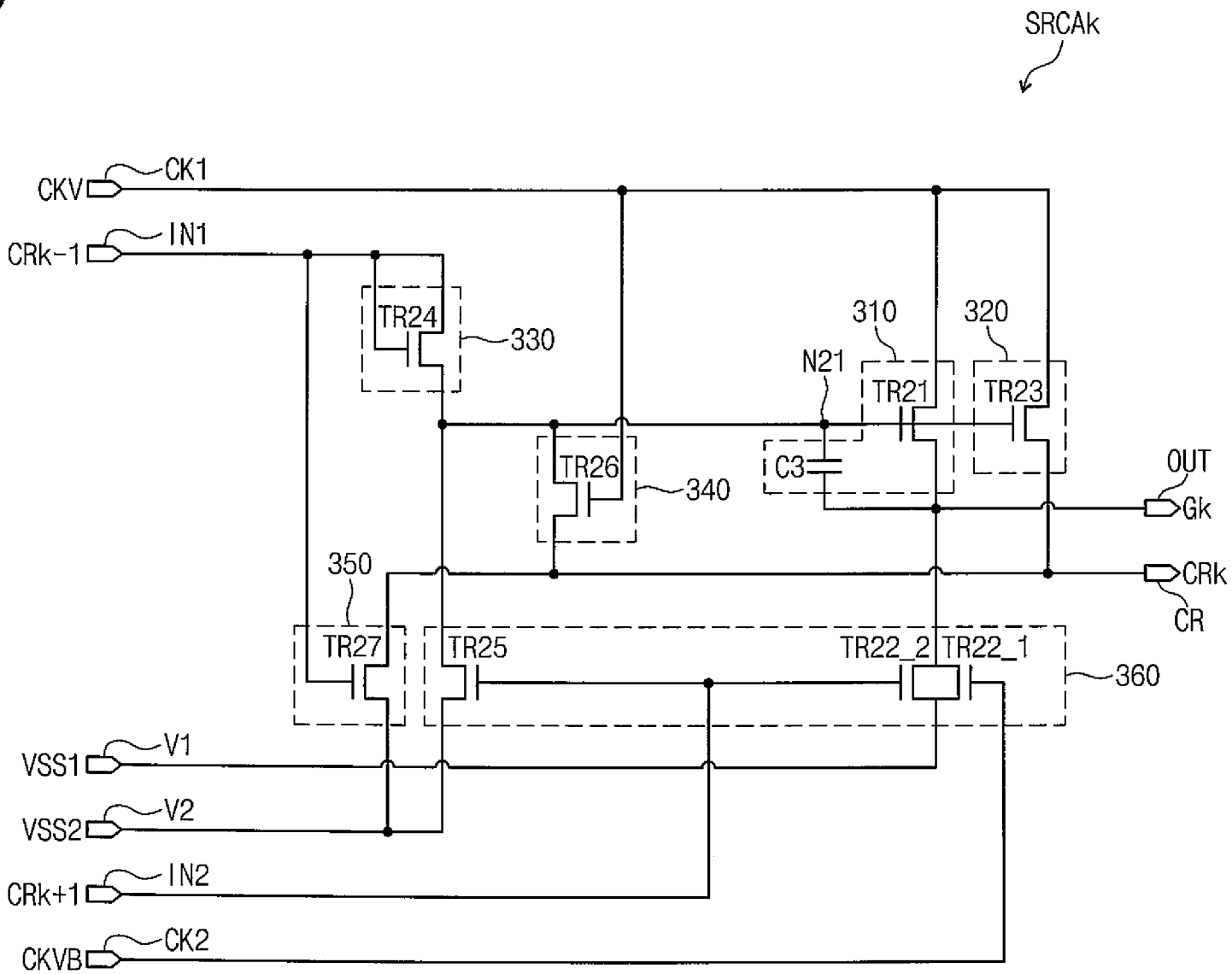
FIGS. 10, 11, and 12 are circuit diagrams of a driving stage according to other embodiments of the Inventive concept.

FIG. 10 is a circuit diagram of a driving stage according to another embodiment of the inventive concept.

FIG. 10 illustrates the k-th driving stage SRCAk (k is a positive integer) among the plurality of driving stages SRCA1 to SRCAn shown in FIG. 9. Each of the plurality of driving stages SRCA1 to SRCAn and the dummy driving stage SRCAn+1 shown in FIG. 9 may have the same circuit as the k-th driving stage SRCAk.

Referring to FIG. 10, the k-th driving stage SRCAk includes a gate output unit 310, a carry output unit 320, a control unit 330, a glitch prevention unit 340, a first discharge unit 350, and a second discharge unit 360.

The gate output unit 310 outputs a first clock signal CKV, which is input to the first clock terminal CK1, to the k-th gate signal Gk in response to a voltage of a first node N21. The carry output unit 320 outputs the first clock signal CKV as the k-th carry signal CRk in response to a voltage of the first node N21. The control unit 330 controls a voltage level of the first node N21 in response to the (k−1)th carry signal CRk−1 Input through the first input terminal IN1. The first discharge unit 350 discharges the k-th carry signal CRk to a ground voltage level in response to the (k−1)th carry signal CRk−1. In some embodiments, the first discharge unit 350 may discharge the k-th carry signal CRk to the second ground voltage VSS2 of the second ground terminal V2 In response to a discharge signal. The second discharge unit 360 discharges the k-th gate signal Gk to the first ground voltage VSS1 of the first ground terminal V1 in response to the second clock signal CKVB input to the second clock terminal CK2, and discharges the k-th gate signal Gk to the first ground voltage VSS1 of the first ground terminal V1 In response to the (k+1)th carry signal CRk+1, and discharges the first node N21 to the second ground voltage VSS2 in response to the (k+1)th carry signal CRk+1.

The first discharge unit 350 includes a first discharge transistor TR27, which includes a first electrode connected to the first clock terminal CK1 to receive the k-th carry signal CRk, a control electrode connected to the first input terminal IN1, and a second electrode connected to the second ground terminal V2 to receive the second ground voltage VSS2.

The second discharge unit 360 includes second to fourth discharge transistors TR22_1, TR22_2, and TR25. The second discharge transistor TR22_1 includes a first electrode connected to the output terminal OUT/the k-th gate signal Gk, a control electrode connected to the second clock signal CKVB, and a second electrode connected to the first ground terminal V1. The third discharge transistor TR22_2 includes a first electrode connected to the output terminal OUT/the k-th gate signal Gk, a control electrode connected to the second input terminal to receive the (k+1)th carry signal CRk+1, and a second electrode connected to the first ground terminal V1. The fourth discharge transistor TR25 includes a first electrode connected to the first node N21, a control electrode connected to the second input terminal IN2 to receive the (k+1)th carry signal CRk+1, and a second electrode connected to the second ground terminal V2 to receive the ground voltage VSS2.

Especially, the second discharge transistor TR22_1 may discharge the output terminal OUT/the k-th gate signal Gk to the first ground voltage VSS1 in response to the second clock signal CKVB, which is complementary to the first clock signal CKV. Therefore, the k-th gate signal Gk driven in a high level may be discharged at a faster speed, and, while not driven in a high level, the k-th gate signal Gk may be held as the first ground voltage VSS1 in accordance with the second clock signal CKVB.

Figure 11:
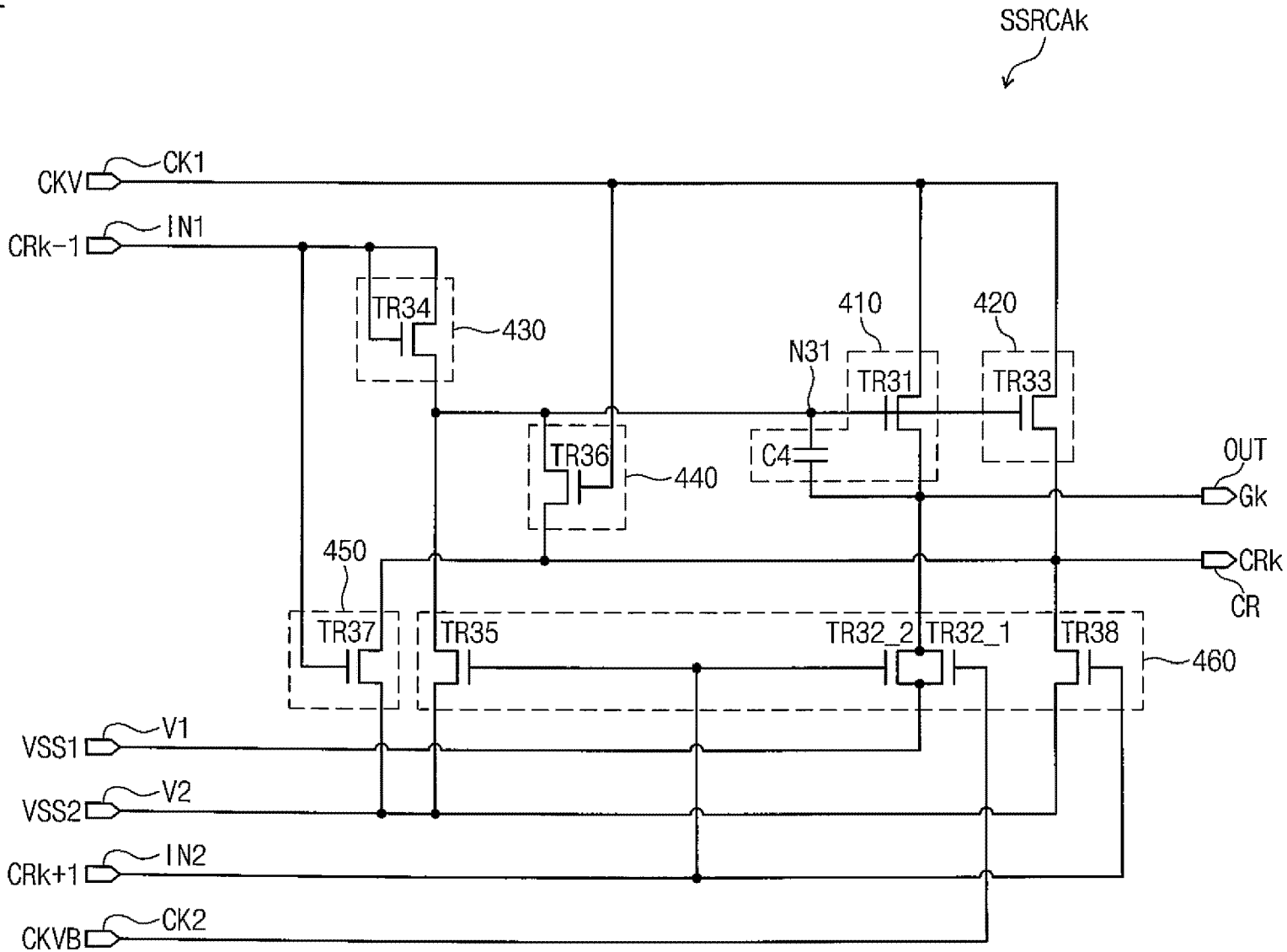

FIG. 11 is a circuit diagram of a driving stage according to another embodiment of the Inventive concept.

FIG. 11 illustrates a k-th driving stage SSRCAk corresponding to the k-th driving stage SRCAk (k is a positive integer) among the plurality of driving stages SRCA1 to SRCAn shown in FIG. 9. Each of the plurality of driving stages SRCA1 to SRCAn and the dummy driving stage SRCAn+1 shown in FIG. 9 may have the same circuit structure as the k-th driving stage SSRCAk shown in FIG. 11.

Referring to FIG. 11, the k-th driving stage SSRCAk includes a gate output unit 410, a carry output unit 420, a control unit 430, a glitch prevention unit 440, a first discharge unit 450, and a second discharge unit 460.

The first discharge unit 450 includes a first discharge transistor TR37. The first discharge transistor TR37 includes a first electrode connected to the carry terminal CR to receive the k-th carry signal CRk, a control electrode connected to the first input terminal IN1, and a second electrode connected to the second ground terminal V2 to receive the voltage VSS2.

The second discharge unit 460 includes second to fifth discharge transistors TR38, TR32_1, TR_32_2, and TR35. The second discharge transistor TR38 includes a first electrode connected to the carry terminal CR to receive the k-th carry signal CRk, a control electrode connected to the second input terminal IN2 to receive the (k+1)th carry signal CRk+1, and a second electrode connected to the second ground terminal V2 to receive the second ground voltage VSS2. The third discharge transistor TR32_1 includes a first electrode connected to the output terminal OUT to receive the k-th gate signal Gk, a control electrode connected to the second clock signal CKVB, and a second electrode connected to the first ground terminal V1. The fourth discharge transistor TR32_2 includes a first electrode connected to the output terminal OUT to receive the k-th gate signal Gk, a control electrode connected to the second input terminal IN2 to receive the (k+1)th carry signal CRk+1, and a second electrode connected to the first ground terminal V1. The fifth discharge transistor TR35 includes a first electrode connected to a first node N31, a control electrode connected to the second input terminal IN2 to receive the (k+1)th carry signal CRk+1, and a second electrode connected to the second ground terminal V2 to receive the second ground voltage VSS2.

Especially, the third discharge transistor TR32_1 may discharge the output terminal OUT/the k-th gate signal Gk to the first ground voltage VSS1 in response to the second clock signal CKVB, which is complementary to the first clock signal CKV. Therefore, while not driven in a high level, the k-th gate signal Gk may be held as the first ground voltage VSS1 in accordance with the second clock signal CKVB.

The second discharge transistor TR38 in the second discharge unit 460 may discharge the output terminal OUT/the k-th carry signal CRk to the second ground voltage VSS2 in response to the (k+1)th carry signal CRk+1. Therefore, the k-th driving stage SSRCAk may output the k-th carry signal CRk in a stable level.

Figure 12:
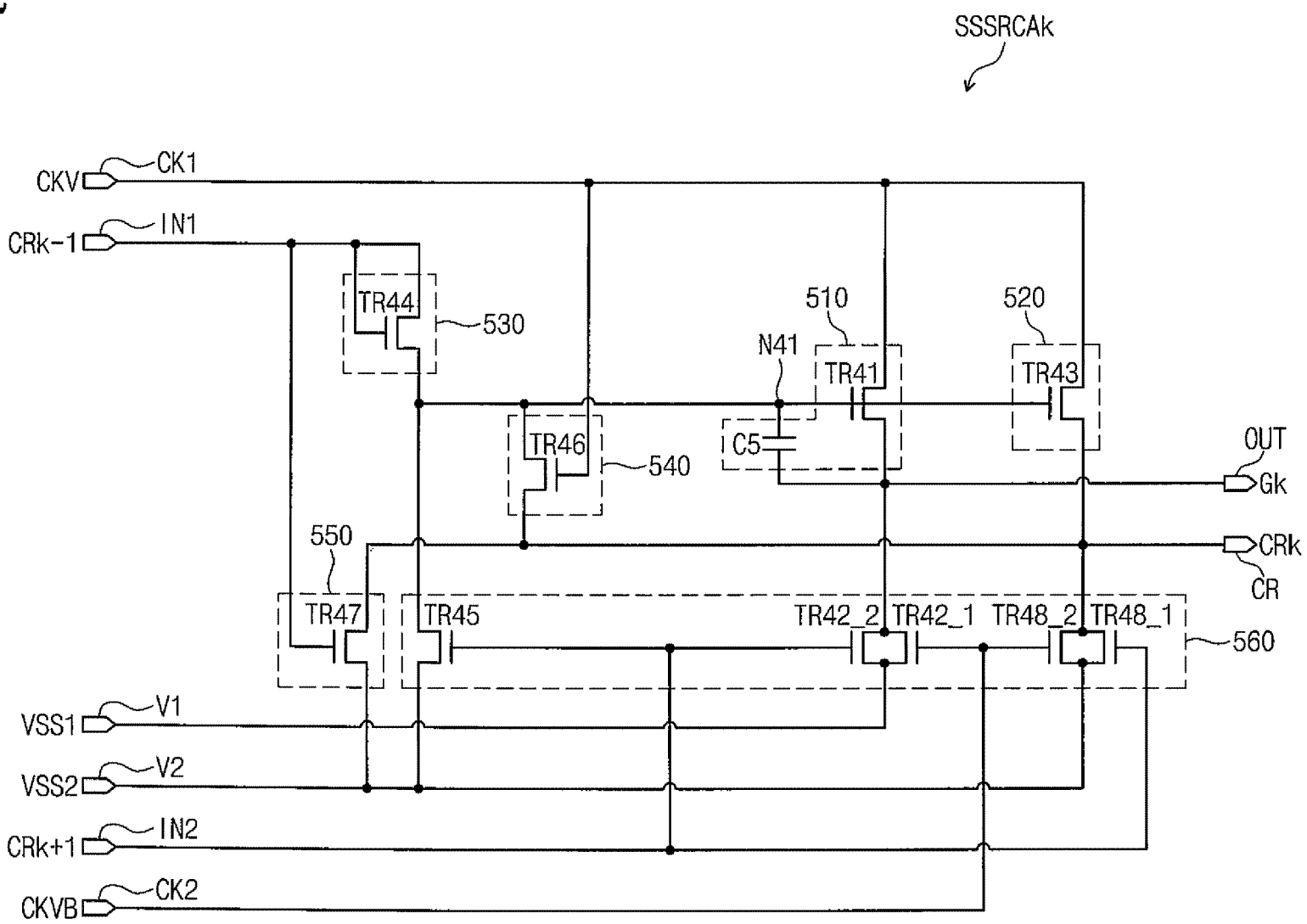

FIG. 12 is a circuit diagram of a driving stage according to another embodiment of the inventive concept.

FIG. 12 illustrates a driving stage SSSRCAk corresponding to the k-th driving stage SRCAk (k is a positive integer) among the plurality of driving stages SRCA1 to SRCAn shown in FIG. 9. Each of the plurality of driving stages SRCA1 to SRCAn and the dummy driving stage SRCAn+1 shown in FIG. 9 may have the same circuit structure as the k-th driving stage SSSRCAk shown in FIG. 12.

Referring to FIG. 12, the k-th driving stage SSSRCAk includes a gate output unit 510, a carry output unit 520, a control unit 530, a glitch prevention unit 540, a first discharge unit 550, and a second discharge unit 560.

The first discharge unit 550 includes a first discharge transistor TR47. The first discharge transistor TR47 includes a first electrode connected to the carry terminal CR to receive the k-th carry signal CRk, a control electrode connected to the first input terminal IN1, and a second electrode connected to the second ground terminal V2 to receive the second ground voltage VSS2.

The second discharge unit 560 includes second to sixth discharge transistors TR48_1, TR48_2, TR_42_1, TR42_2, and TR45. The second discharge transistor TR48_1 includes a first electrode connected to the carry terminal CR to receive the k-th carry signal CRk, a control electrode connected to the second input terminal IN2 to receive the (k+1)th carry signal CRk+1, and a second electrode connected to the second ground voltage VSS2. The third discharge transistor TR48_1 includes a first electrode connected to the k-th carry signal CRk, a control electrode connected to the second clock signal CKVB, and a second electrode connected to the second ground terminal V2 to receive the second ground voltage VSS2.

The fourth discharge transistor TR42_1 includes a first electrode connected to the output terminal OUT to receive the k-th gate signal Gk, a control electrode connected to the second clock terminal CK2 to receive the second clock signal CKVB, and a second electrode connected to the first ground terminal V1 to receive the ground voltage VSS1. The fifth discharge transistor TR42_2 includes a first electrode connected to the output terminal OUT to receive the k-th gate signal Gk, a control electrode connected to the second input terminal IN2 to receive the (k+1)th carry signal CRk+1, and a second electrode connected to the first ground terminal V1 to receive the first ground voltage VSS1. The sixth discharge transistor TR45 includes a first electrode connected to the first node N41, a control electrode connected to the second input terminal IN2 to receive the (k+1)th carry signal CRk+1, and a second electrode connected to the second ground terminal V2 to receive the second ground voltage VSS2.

Especially, the fourth discharge transistor TR42_1 in the second discharge unit 560 may discharge the output terminal OUT/the k-th gate signal Gk to the first ground voltage VSS1 in response to the second clock signal CKVB, which is complementary to the first clock signal CKV. Therefore, while not driven in a high level, the k-th gate signal Gk may be held as the first ground voltage VSS1 in accordance with the second clock signal CKVB. Similarly, the third discharge transistor TR48_2 in the second discharge unit 560 may discharge the output terminal OUT/the k-th carry signal CRk to the second ground voltage VSS2 in response to the second clock signal CKVB. Therefore, while not driven in a high level, the k-th carry signal CRk may be held as the second ground voltage VSS2 in accordance with the second clock signal CKVB.

The second discharge transistor TR48_1 in the second discharge unit 560 may discharge the k-th carry signal CRk to the second ground voltage VSS2 in response to the (k+1)th carry signal CRk+1. Therefore, the k-th driving stage SSSRCAk may output the k-th carry signal CRk in a stable level.

Figure 13:
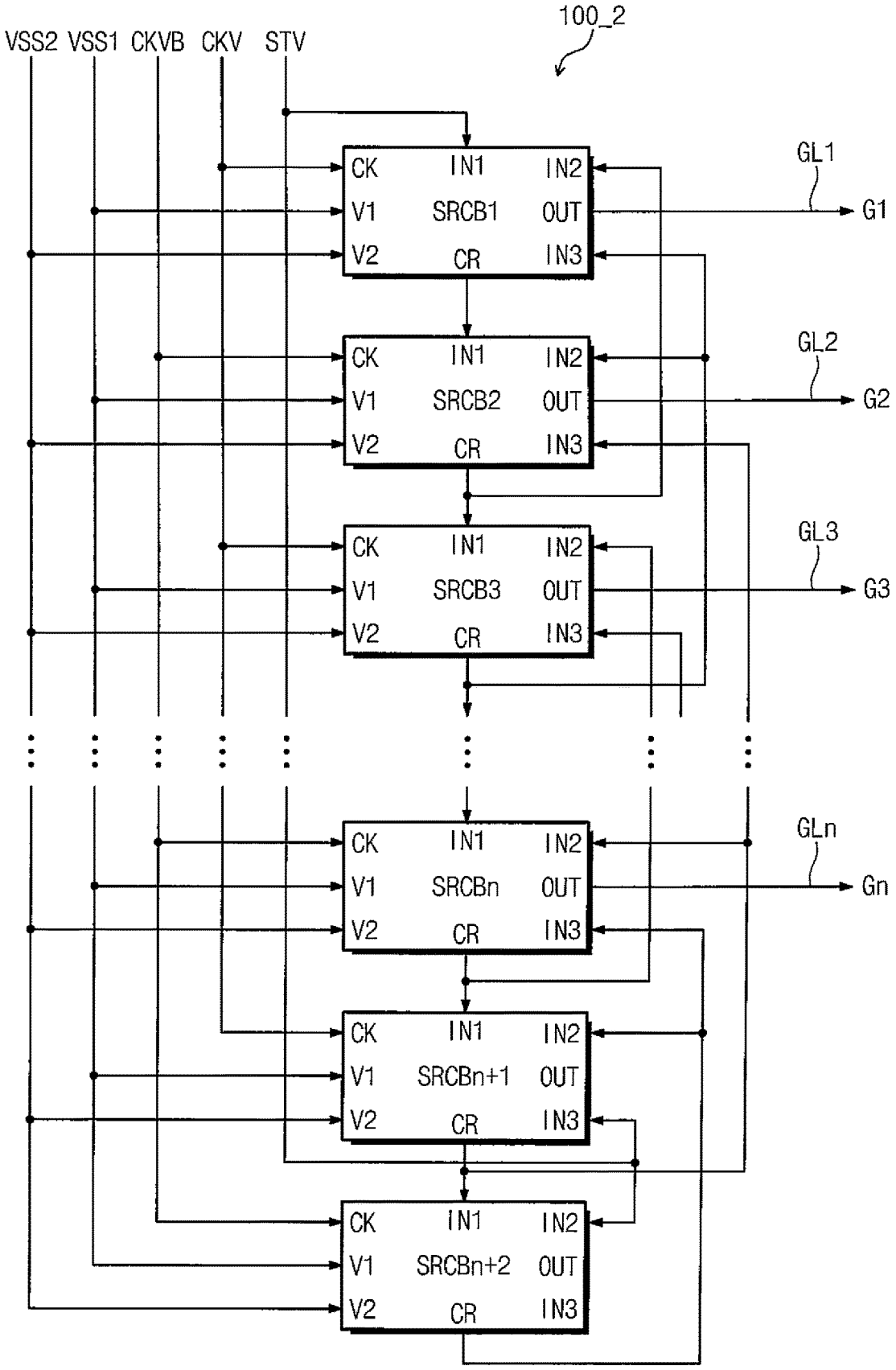
FIG. 13 is a block diagram illustrating a gate driving circuit according to another embodiment of the inventive concept.

FIG. 13 is a block diagram illustrating a gate driving circuit according to another embodiment of the inventive concept.

As shown in FIG. 13, a gate driving circuit 100_2 includes a plurality of driving stages SRCB1 to SRCBn and dummy driving stages SRCBn+1 and SRCBn+2. The plurality of driving stages SRCB1 to SRCBn and dummy driving stages SRCBn+1 and SRCBn+2 have a cascade relationship, in which they operate in response to a carry signal output from a previous stage, a carry signal output from the next stage, and a carry signal output from the next next stage.

Each of the plurality of driving stages SRCB1 to SRCBn receives either a first clock signal CKV or a second clock signal CKVB, a first ground voltage VSS1, and a second ground voltage VSS2 from the driving controller 300 shown in FIG. 1. The driving stage SRCB1 and the dummy driving stage SRCBn+1 receive a vertical start signal STV. Especially, unlike the plurality of driving stages SRC1 to SRCn and the dummy driving stage SRCn+1 shown in FIG. 5, each of the plurality of driving stages SRCB1 to SRCBn and the dummy driving stage SRCBn+1 also receives a carry signal from the next next stage. For example, the k-th driving stage SRCBk further receives the (k+2)th carry signal CRk+2 from the (k+2)th driving stage SRCBk+2.

The plurality of driving stages SRCB1 to SRCBn are respectively connected to the plurality of gate lines GL1 to GLn, and respectively provide gate signals G1 to Gn to the plurality of gate lines GL1 to GLn. Each of the plurality of driving stages SRCB1 to SRCBn and the dummy driving stage SRCBn+1 includes input terminals IN1 IN2, and IN3, an output terminal OUT, a carry terminal CR, a clock terminal CK, a first ground terminal V1, and a second ground terminal V2.

The output terminal OUT of each of the plurality of driving stages SRCB1 to SRCBn is connected to a corresponding gate line among the plurality of gate lines GL1 to GLn. The gate signals G1 to Gn generated from the plurality of driving stages SRCB1 to SRCBn are provided to the plurality of gate lines GL1 to GLn through the output terminal OUT.

The carry terminal CR of each of the plurality of driving stages SRCB1 to SRCBn is electrically connected to the first input terminal IN1 of a corresponding next driving stage, is electrically connected to the second input terminal IN2 of a previous driving stage, and is electrically connected to a third input terminal IN3 of a previous previous driving stage (e.g., a driving stage that is two driving stages before the current driving stage). For example, the carry terminal CR of the k-th driving stage among the driving stages SRCB1 to SRCBn is connected to the first input terminal IN1 of the (k+1)th driving stage SRCBk+1, the second input terminal IN2 of the (k−1)th driving stage SRCBk−1, and the third input terminal IN3 of the k−2th driving stage SRCBk−2. The carry terminal CR of each of the plurality of driving stages SRCB1 to SRCBn and dummy driving stages SRCBn+1 and SRCBn+2 outputs a carry signal.

The first input terminal IN1 of each of the plurality of driving stages SRCB2 to SRCBn and dummy driving stages SRCBn+1 and SRCBn+2 receives a carry signal of a corresponding previous driving stage/dummy driving stage. The second input terminal IN2 of each of the plurality of driving stages SRCB2 to SRCBn and the dummy driving stage SRCBn+1 receives a carry signal from the carry terminal CR of a corresponding next driving stage/dummy driving stage. The third input terminal IN3 of each of the plurality of driving stages SRCB2 to SRCBn receives a carry signal from the carry terminal CR of a corresponding next next driving stage/dummy driving stage. The third input terminal IN3 of the dummy driving stage SRCBn+1 and the second input terminal IN2 of the dummy driving stage SRCBn+2 receive a vertical start signal STV.

The clock terminal CK of each of the plurality of driving stages SRCB2 to SRCBn and dummy driving stages SRCBn+1 and SRCBn+2 receives either the first clock signal CKV or the second clock signal CKVB. For example, the clock terminal CK of each of the odd driving stages SRCA1, SRCA3, . . . , SRCAn−1 and the dummy driving stage SRCAn+1 receives the first clock signal CKV, while the clock terminal CK of each of the even driving stages SRCA2, SRCA4, . . . , SRCAn and the dummy driving stage SRCAn+2 receives the second clock signal CKVB. The first clock signal CKV and the second clock signal CKVB may have different phases. The first clock signal CKV and the second clock signal CKVB may be pulse signals having a complementary level. The first ground terminal V1 of each of the plurality of driving stages SRCB1 to SRCBn and dummy driving stages SRCBn+1 and SRCBn+2 receives a first ground voltage VSS1. The second ground terminal V2 of each of the plurality of driving stages SRCB1 to SRCBn and dummy driving stages SRCBn+1 and SRCBn+2 receives a second ground voltage VSS2. The first ground voltage VSS1 and the second ground voltage VSS2 have different voltage levels, and the second ground voltage VSS2 has a lower voltage level than the first ground voltage VSS1.

Figure 14:
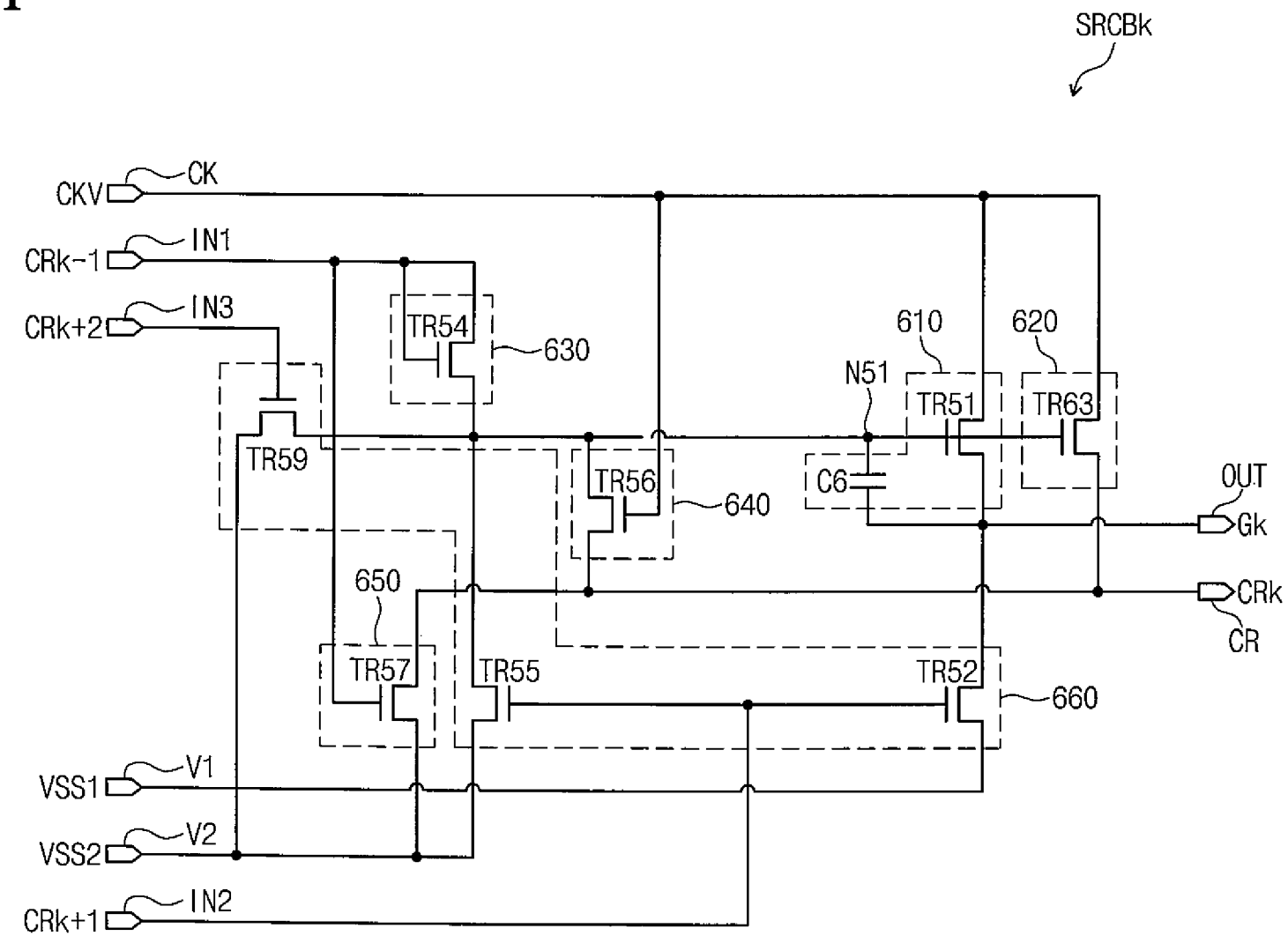
FIGS. 14 and 15 are circuit diagrams of a driving stage according to other embodiments of the inventive concept.

FIG. 14 is a circuit diagram of a driving stage according to another embodiment of the Inventive concept.

FIG. 14 illustrates the k-th driving stage SRCBk (k is a positive integer) among the plurality of driving stages SRCB1 to SRCBn shown in FIG. 13. Each of the plurality of driving stages SRCB1 to SRCBn and dummy driving stages SRCBn+1 and SRCBn+2 shown in FIG. 13 may have the same circuit structure as the k-th driving stage SRCBk.

Referring to FIG. 14, the k-th driving stage SRCBk includes a gate output unit 610, a carry output unit 620, a control unit 630, a glitch prevention unit 640, a first discharge unit 650, and a second discharge unit 660.

The gate output unit 610 outputs a first clock signal CKV, which is input to the first clock terminal CK1, as the k-th gate signal Gk in response to a voltage of a first node N51. The carry output unit 620 outputs the first clock signal CKV as the k-th carry signal CRk in response to a voltage of the first node N51. The control unit 630 controls a voltage level of the first node N51 in response to the (k−1)th carry signal CRk−1 Input through the first input terminal IN1. The first discharge unit 650 discharges the k-th carry signal CRk to a ground voltage level in response to the (k−1)th carry signal CRk−1. In some embodiments, the first discharge unit 650 discharges the k-th carry signal CRk to the second ground voltage VSS2 of the second ground terminal V2 in response to a discharge signal. The second discharge unit 660 discharges the k-th gate signal Gk to the first ground voltage VSS1 of the first ground terminal V1 in response to the (k+1)th carry signal CRk+1, discharges the first node N51 to the second ground voltage VSS2 in response to the (k+1)th carry signal CRk+1, and discharges the first node N51 to the second ground voltage VSS2 of the second ground terminal V2 in response to the (k+2)th carry signal CRk+2.

The first discharge unit 650 includes a first discharge transistor TR57. The first discharge transistor TR57 includes a first electrode connected to the k-th carry signal CRk, a control electrode connected to the first input terminal IN1, and a second electrode connected to the second ground voltage VSS2.

The second discharge unit 660 includes second to fourth discharge transistors TR52, TR55, and TR59. The second discharge transistor TR52 includes a first electrode connected to the k-th gate signal Gk, a control electrode connected to the (k+1)th carry signal CRk+1, and a second electrode connected to the first ground voltage VSS1. The third discharge transistor TR55 includes a first electrode connected to the first node N51, a control electrode connected to the (k+1)th carry signal CRk+1, and a second electrode connected to the second ground voltage VSS2. The fourth discharge transistor TR59 includes a first electrode connected to the first node N51, a control electrode connected to the (k+2)th carry signal CRk+2, and a second electrode connected to the second ground voltage VSS2.

Especially, the fourth discharge transistor TR59 may discharge the first node N51 to the second ground voltage VSS2 in response to the (k+2)th carry signal CRk+2. As a voltage level of the first node N51 rises, the first output transistor TR51 and the second output transistor TR63 respectively output the k-th gate signal Gk and the k-th carry signal CRk corresponding to the first clock signal CKV. Then, when the (k+1)th carry signal CRk+1 is output, the third discharge transistor TR55 is turned on, so that a voltage level of the first node N51 is discharged to the second ground voltage VSS2. Then, when the (k+2)th carry signal CRk+2 is output, the fourth discharge transistor TR59 is turned on, so that a voltage level of the first node N51 may be maintained as the second ground voltage VSS2. Therefore, because a voltage level of the first node N51 becomes stable, the reliability of the gate driving circuit 100 shown in FIG. 1 may be improved.

Figure 15:
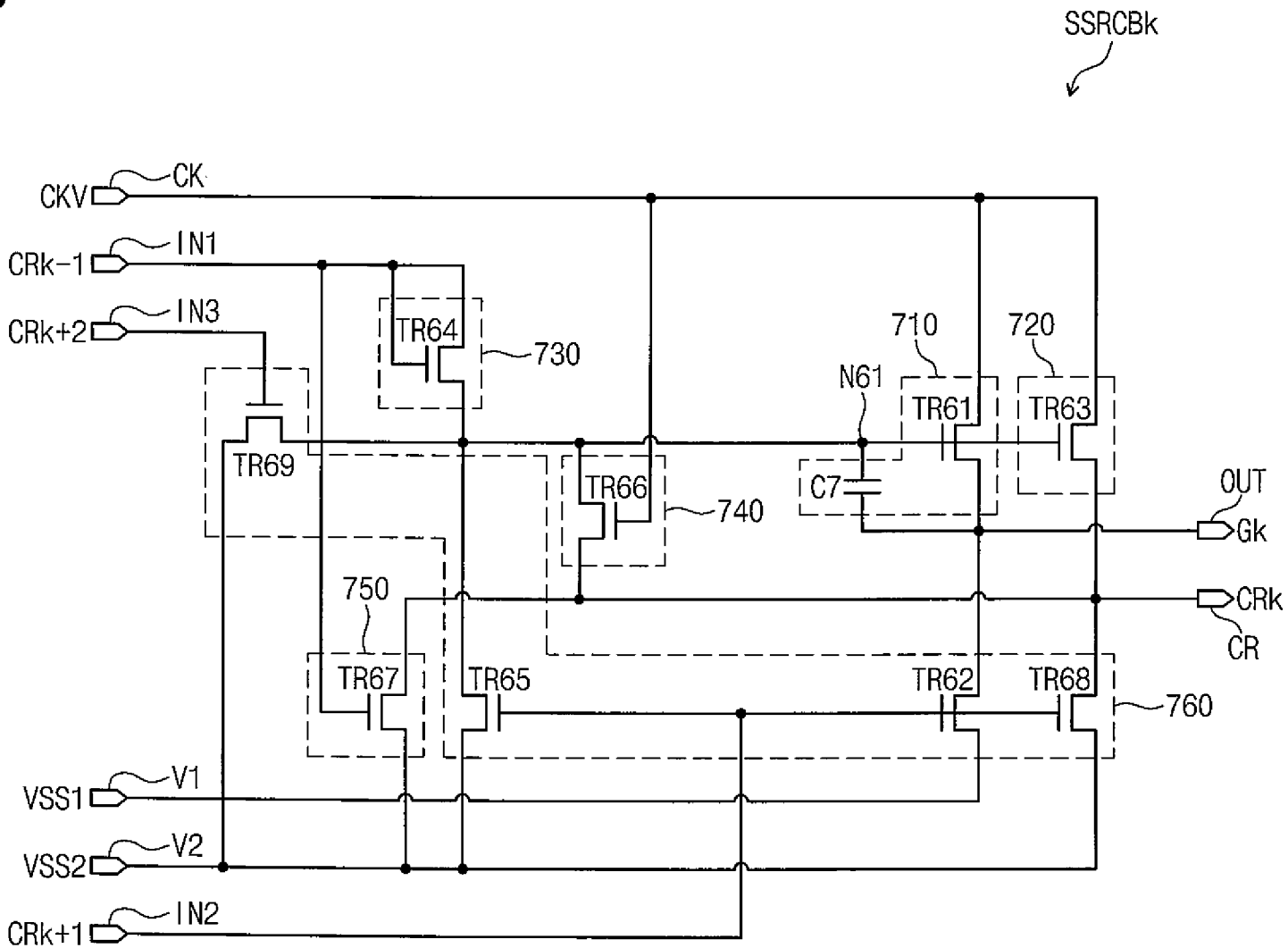

FIG. 15 is a circuit diagram of a driving stage according to another embodiment of the Inventive concept.

FIG. 15 illustrates a k-th driving stage SSRCBk corresponding to the k-th driving stage SRCBk (k is a positive integer) among the plurality of driving stages SRCB1 to SRCBn shown in FIG. 13. Each of the plurality of driving stages SRCB1 to SRCBn and dummy driving stages SRCBn+1 and SRCBn+2 shown in FIG. 13 may have the same circuit as the k-th driving stage SSRCBk.

Referring to FIG. 15, the k-th driving stage SSRCBk includes a gate output unit 710, a carry output unit 720, a control unit 730, a glitch prevention unit 740, a first discharge unit 750, and a second discharge unit 760.

The k-th driving stage SSRCBk shown in FIG. 15 may have a similar configuration to the k-th driving stage SRCBk shown in FIG. 14, or may further include a discharge transistor TR68 in the second discharge unit 760.

The first discharge unit 750 includes a first discharge transistor TR67. The first discharge transistor TR67 includes a first electrode connected to the k-th carry signal CRk, a control electrode connected to the first input terminal IN1, and a second electrode connected to the second ground voltage VSS2.

The second discharge unit 760 includes second to fifth discharge transistors TR68, TR62, TR65, and TR69. The second discharge transistor TR68 includes a first electrode connected to the k-th carry signal CRk, a control electrode connected to the (k+1)th carry signal CRk+1, and a second electrode connected to the second ground voltage VSS2. The third discharge transistor TR62 includes a first electrode connected to the k-th gate signal Gk, a control electrode connected to the (k+1)th carry signal CRk+1, and a second electrode connected to the first ground voltage VSS1. The fourth discharge transistor TR65 includes a first electrode connected to a first node N61, a control electrode connected to the (k+1)th carry signal CRk+1, and a second electrode connected to the second ground voltage VSS2. The fifth discharge transistor TR69 includes a first electrode connected to the first node N61, a control electrode connected to the (k+2)th carry signal CRk+2, and a second electrode connected to the second ground voltage VSS2.

The second discharge transistor TR68 in the second discharge unit 760 discharges the k-th carry signal CRk to the second ground voltage VSS2 in response to the (k+1)th carry signal CRk+1. Therefore, the k-th driving stage SSRCBk may output the k-th carry signal CRk in a stable level.

Figure 16:
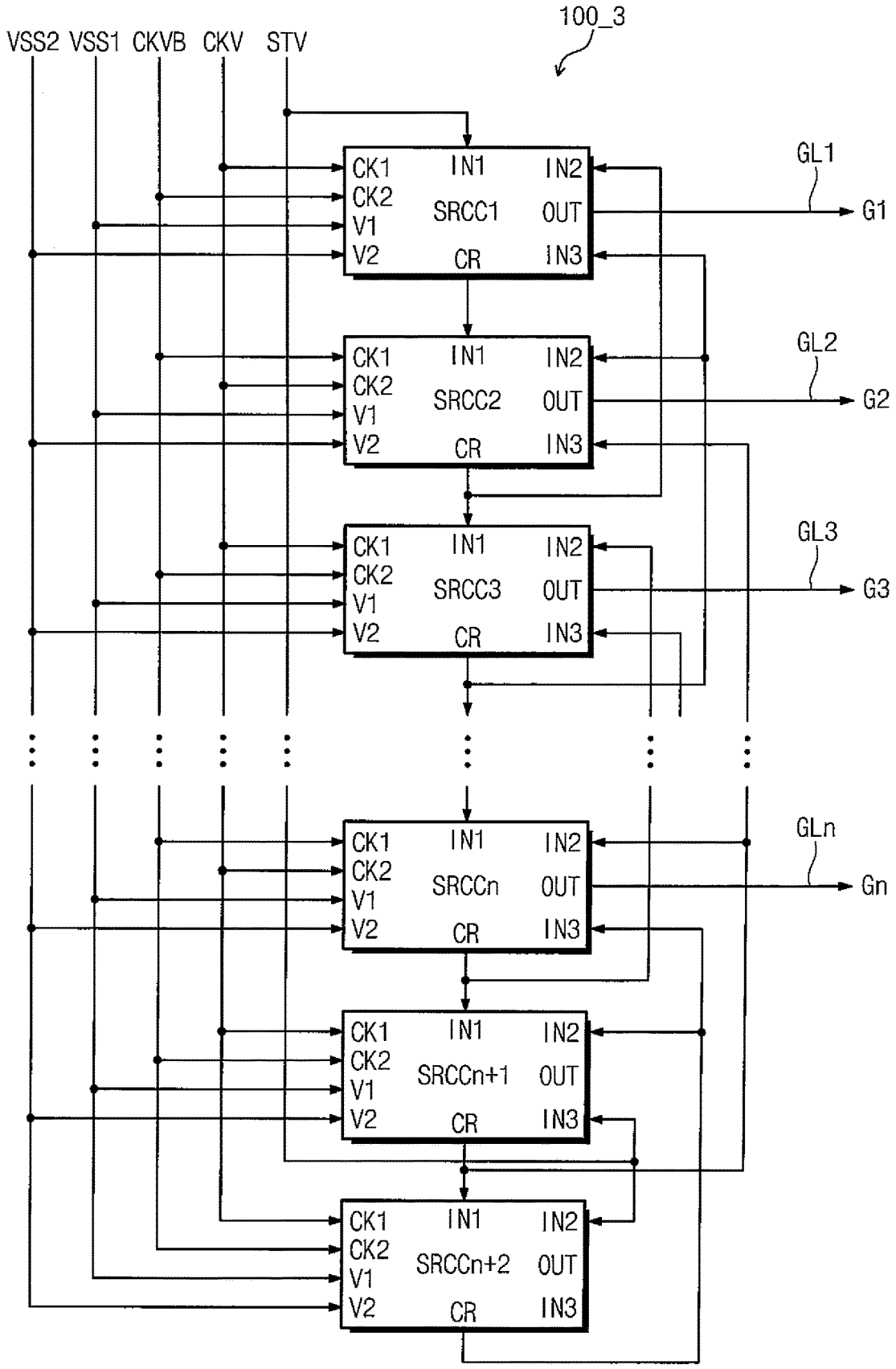
FIG. 16 is a block diagram illustrating a gate driving circuit according to another embodiment of the Inventive concept.

FIG. 16 is a block diagram illustrating a gate driving circuit according to another embodiment of the Inventive concept.

As shown in FIG. 16, a gate driving circuit 100_3 includes a plurality of driving stages SRCC1 to SRCCn and dummy driving stages SRCCn+1 and SRCCn+2. The plurality of driving stages SRCC1 to SRCCn and dummy driving stages SRCCn+1 and SRCCn+2 have a cascade relationship in which they operate in response to a carry signal output from a previous stage, a carry signal output from the next stage, and a carry signal output from the next next stage.

Each of the plurality of driving stages SRCC1 to SRCCn receives a first clock signal CKV, a second clock signal CKVB, a first ground voltage VSS1, and a second ground voltage VSS2 from the driving controller 300 shown in FIG. 1. The driving stage SRCC1 and the dummy driving stages SRCCn+1 and SRCCn+1 receive a vertical start signal STV. Especially, unlike the plurality of driving stages SRCB1 to SRCBn and dummy driving stages SRCBn+1 and SRCBn+2 shown in FIG. 13, each of the plurality of driving stages SRCC1 to SRCCn and dummy driving stages SRCCn+1 and SRCCn+2 shown in FIG. 16 receives both the second clock signal CKVB, which is complementary to the first clock signal CKV, and the first clock signal CKV.

Each of the plurality of driving stages SRCC1 to SRCCn and the dummy driving stages SRCCn+1 and SRCCn+2 Includes input terminals IN1 and IN2, an output terminal OUT, a carry terminal CR, a first clock terminal CK1, a second clock terminal CK2, a first ground terminal V1, and a second ground terminal V2.

Figure 17:
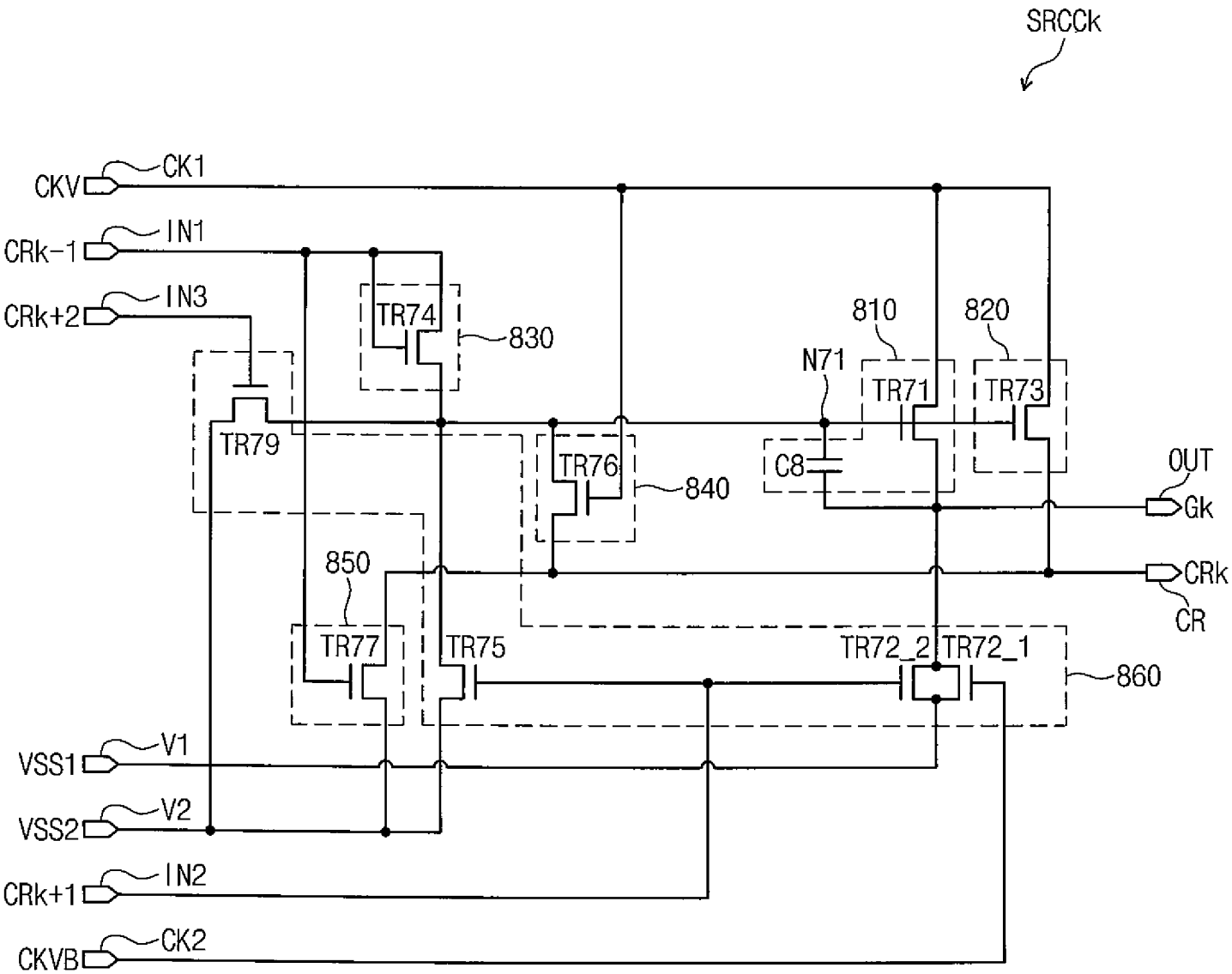
FIGS. 17, 18, and 19 are circuit diagrams of a driving stage according to other embodiments of the inventive concept.

FIG. 17 is a circuit diagram of a driving stage according to another embodiment of the inventive concept.

FIG. 17 illustrates the k-th driving stage SRCCk (k is a positive integer) among the plurality of driving stages SRCC2 to SRCCn shown in FIG. 16. Each of the plurality of driving stages SRCC1 to SRCCn and dummy driving stages SRCCn+1 and SRCCn+2 shown in FIG. 16 may have the same circuit structure as the k-th driving stage SRCCk.

Referring to FIG. 17, the k-th driving stage SRCCk includes a gate output unit 810, a carry output unit 820, a control unit 830, a glitch prevention unit 840, a first discharge unit 850, and a second discharge unit 860.

The first discharge unit 850 includes a first discharge transistor TR77. The first discharge transistor TR77 includes a first electrode connected to the k-th carry signal CRk, a control electrode connected to the (k−1)th carry signal CRk−1, and a second electrode connected to the second ground voltage VSS2.

The second discharge unit 860 includes second to fifth discharge transistors TR72_1, TR72_2, TR75, and TR79. The second discharge transistor TR72_1 includes a first electrode connected to the k-th gate signal Gk, a control electrode connected to the second clock signal CKVB, and a second electrode connected to the first ground voltage VSS1. The third discharge transistor TR72_2 includes a first electrode connected to the k-th gate signal Gk, a control electrode connected to the (k+1)th carry signal CRk+1, and a second electrode connected to the first ground voltage VSS1. The fourth discharge transistor TR75 includes a first electrode connected to a first node N71, a control electrode connected to the (k+1)th carry signal CRk+1, and a second electrode connected to the second ground voltage VSS2. The fourth discharge transistor TR79 includes a first electrode connected to the first node N71, a control electrode connected to the (k+2)th carry signal CRk+2, and a second electrode connected to the second ground voltage VSS2.

Especially, the fourth discharge transistor TR79 may discharge the first node N71 to the second ground voltage VSS2 in response to the (k+2)th carry signal CRk+2. As a voltage level of the first node N71 rises, the first output transistor TR71 and the second output transistor TR73 respectively output the k-th gate signal Gk and the k-th carry signal CRk corresponding to the first clock signal CKV. Then, when the (k+1)th carry signal CRk+1 is output, the third discharge transistor TR75 is turned on, so that a voltage level of the first node N71 is discharged to the second ground voltage VSS2. Then, when the (k+2)th carry signal CRk+2 is output, the fourth discharge transistor TR79 is turned on, so that a voltage level of the first node N71 may be maintained as the second ground voltage VSS2. Therefore, because a voltage level of the first node N71 becomes stable, the reliability of the gate driving circuit 100 shown in FIG. 1 may be improved.

Figure 18:
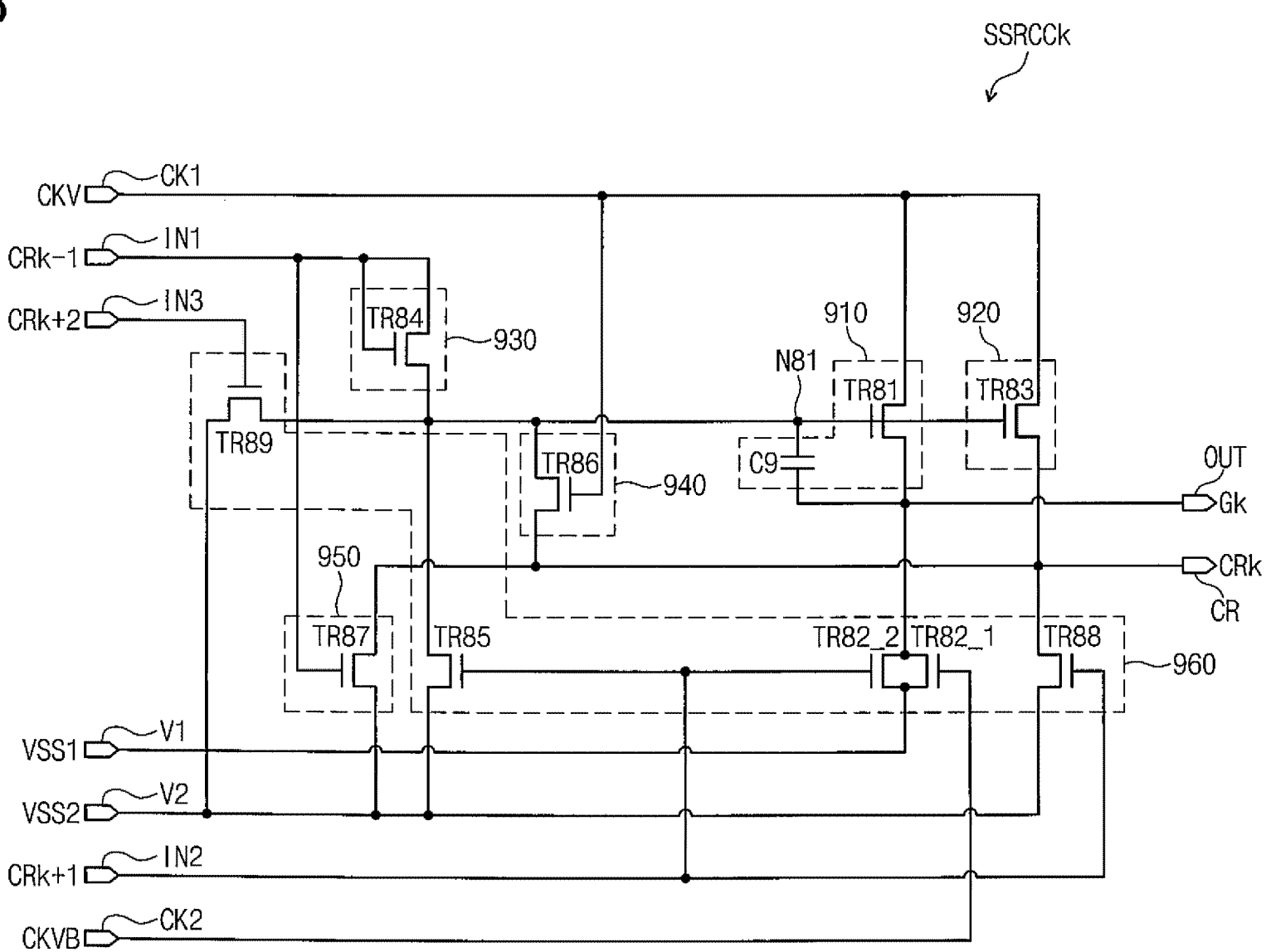

FIG. 18 is a circuit diagram of a driving stage according to another embodiment of the inventive concept.

FIG. 18 illustrates a k-th driving stage SSRCCk corresponding to the k-th driving stage SRCCk (k is a positive integer) among the plurality of driving stages SRCC1 to SRCCn shown in FIG. 16. Each of the plurality of driving stages SRCC1 to SRCCn and dummy driving stages SRCCn+1 and SRCCn+2 shown in FIG. 16 may have the same circuit as the k-th driving stage SSRCCk.

Referring to FIG. 18, the k-th driving stage SSRCCk includes a gate output unit 910, a carry output unit 920, a control unit 930, a glitch prevention unit 940, a first discharge unit 950, and a second discharge unit 960.

The first discharge unit 950 includes a first discharge transistor TR87. The first discharge transistor TR87 includes a first electrode connected to the k-th carry signal CRk, a control electrode connected to the (k−1)th carry signal CRk−1, and a second electrode connected to the second ground voltage VSS2.

The second discharge unit 960 includes second to sixth discharge transistors TR88, TR82_1, TR82_2, TR85, and TR89. The second discharge transistor TR88 includes a first electrode connected to the k-th carry signal CRk, a control electrode connected to the (k+1)th carry signal CRk+1, and a second electrode connected to the second ground voltage VSS2. The third discharge transistor TR82_1 includes a first electrode connected to the k-th gate signal Gk, a control electrode connected to the second clock signal CKVB, and a second electrode connected to the first ground voltage VSS1. The fourth discharge transistor TR82_2 includes a first electrode connected to the k-th gate signal Gk, a control electrode connected to the (k+1)th carry signal CRk+1, and a second electrode connected to the first ground voltage VSS1. The fifth discharge transistor TR85 includes a first electrode connected to the first node N81, a control electrode connected to the (k+1)th carry signal CRk+1, and a second electrode connected to the second ground voltage VSS2. The sixth discharge transistor TR89 includes a first electrode connected to the first node N81, a control electrode connected to the (k+2)th carry signal CRk+2, and a second electrode connected to the second ground voltage VSS2.

The k-th driving stage SSRCCk shown in FIG. 18 may further include the second discharge transistor TR88 in the circuit configuration of the k-th driving stage SRCCk shown in FIG. 17.

The second discharge transistor TR88 in the second discharge unit 960 discharges the k-th carry signal CRk to the second ground voltage VSS2 in response to the (k+1)th carry signal CRk+1. Therefore, the k-th driving stage SSRCCk may output the k-th carry signal CRk in a stable level.

Figure 19:
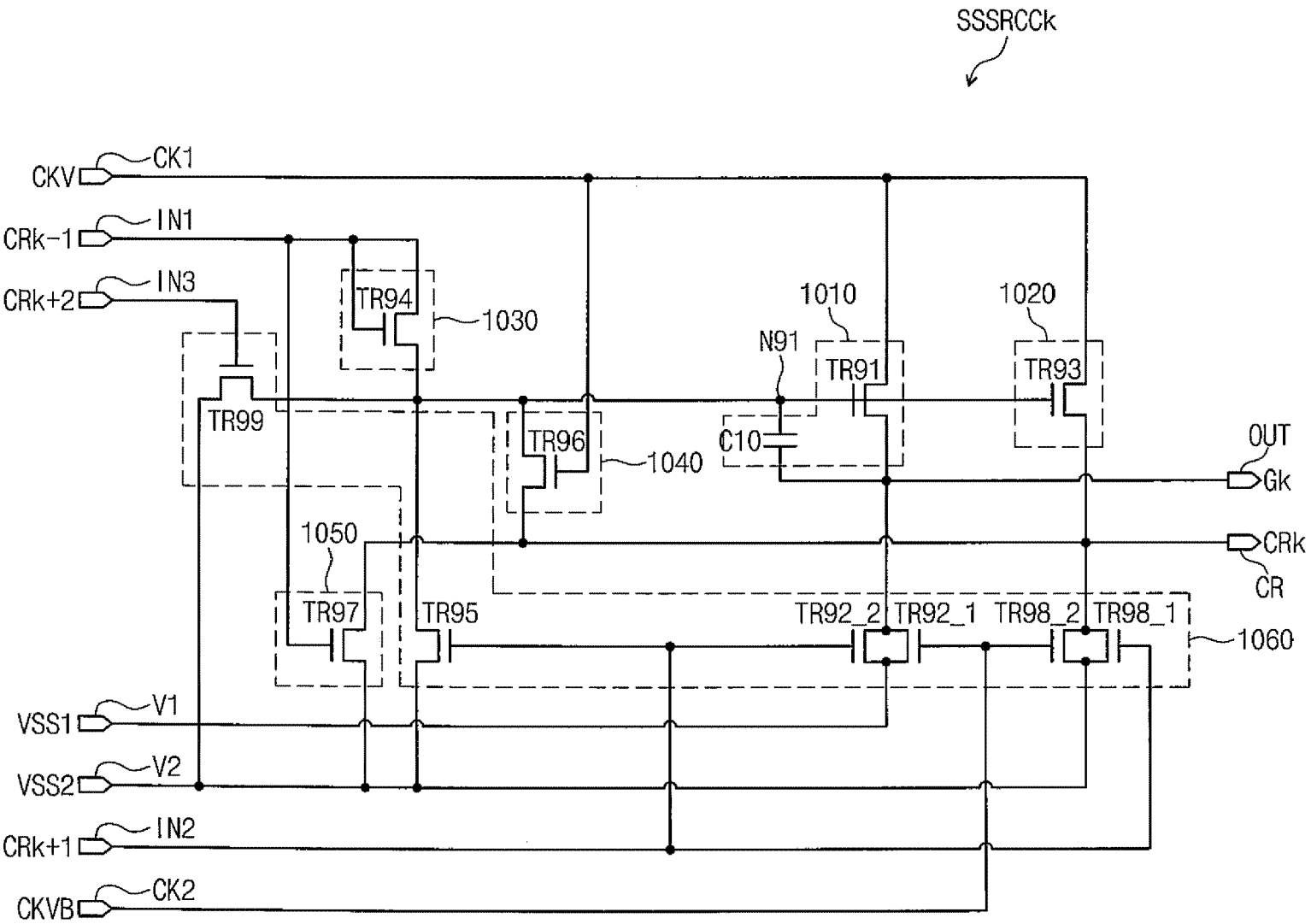

FIG. 19 is a circuit diagram of a driving stage according to another embodiment of the inventive concept.

FIG. 19 illustrates a driving stage SSSRCCk corresponding to the k-th driving stage SRCCk (k is a positive integer) among the plurality of driving stages SRCC1 to SRCCn shown in FIG. 16. Each of the plurality of driving stages SRCC1 to SRCCn and dummy driving stages SRCCn+1 and SRCCn+2 shown in FIG. 16 may have the same circuit structure as the k-th driving stage SSSRCCk.

Referring to FIG. 19, the k-th driving stage SSSRCCk includes a gate output unit 1010, a carry output unit 1020, a control unit 1030, a glitch prevention unit 1040, a first discharge unit 1050, and a second discharge unit 1060.

The first discharge unit 1050 includes a first discharge transistor TR97. The first discharge transistor TR97 includes a first electrode connected to the k-th carry signal CRk, a control electrode connected to the (k−1)th carry signal CRk−1, and a second electrode connected to the second ground voltage VSS2.

The second discharge unit 1060 includes second to seventh discharge transistors TR98_1, TR98_2, TR92_1, TR92_2, TR95, and TR99. The second discharge transistor TR98_1 includes a first electrode connected to the k-th carry signal CRk, a control electrode connected to the (k+1)th carry signal CRk+1, and a second electrode connected to the second ground voltage VSS2.

The third discharge transistor TR98_2 includes a first electrode connected to the k-th carry signal CRk, a control electrode connected to the second clock signal CKVB, and a second electrode connected to the second ground voltage VSS2. The fourth discharge transistor TR92_1 includes a first electrode connected to the k-th gate signal Gk, a control electrode connected to the second clock signal CKVB, and a second electrode connected to the first ground voltage VSS1. The fifth discharge transistor TR92_2 includes a first electrode connected to the k-th gate signal Gk, a control electrode connected to the (k+1)th carry signal CRk+1, and a second electrode connected to the first ground voltage VSS1. The sixth discharge transistor TR95 includes a first electrode connected to a first node N91, a control electrode connected to the (k+1)th carry signal CRk+1, and a second electrode connected to the second ground voltage VSS2. The seventh discharge transistor TR99 includes a first electrode connected to the first node N91, a control electrode connected to the (k+2)th carry signal CRk+2, and a second electrode connected to the second ground voltage VSS2.

The k-th driving stage SSSRCCk shown in FIG. 19 may further include the third discharge transistor TR98_2 in addition to the remaining circuit configuration of the k-th driving stage SSRCCk shown in FIG. 18.

The third discharge transistor TR98_2 in the second discharge unit 1060 may discharge the k-th carry signal CRk to the second ground voltage VSS2 in response to the second clock signal CKVB, which is complementary to the first clock signal CKV. Therefore, the k-th carry signal CRk driven in a high level may be discharged at a faster speed, and, while not driven in a high level, the k-th carry signal CRk may be held as the second ground voltage VSS2 in accordance with the second clock signal CKVB.

In a gate driving circuit having such a configuration, the number of transistors required for driving a gate line is reduced. Therefore, the area of the gate driving circuit may be reduced. Additionally, the reliability of the gate driving circuit may be improved by reducing glitch noise occurring during an operation of the gate driving circuit.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed by the claims and their equivalents.

What is claimed is:

1. A gate driving circuit comprising driving stages for providing gate signals to gate lines of a display panel, wherein a k-th driving stage (k being a natural number equal to or greater than 2) among the driving stages comprises:

a gate output unit configured to output a clock signal received from a clock terminal of the k-th driving stage as a k-th gate signal of the gate signals in response to a voltage of a first node;

a carry output unit configured to output the clock signal as a k-th carry signal in response to the voltage of the first node;

a control unit configured to control the voltage of the first node in response to a (k−1)th carry signal;

a first discharge unit configured to discharge the k-th carry signal to a first voltage in response to the (k−1)th carry signal, and comprising a single first discharge transistor comprising a first electrode configured to receive the k-th carry signal, a second electrode configured to receive the first voltage, and a control electrode configured to receive the (k−1)th carry signal;

a second discharge unit configured to discharge the k-th carry signal to the first voltage in response to a discharge signal; and a glitch prevention unit comprising a transistor comprising a first electrode connected to the first node, a second electrode configured to receive the k-th carry signal, and a control electrode directly connected to the clock terminal and configured to receive the clock signal, wherein the transistor of the glitch prevention unit is configured to discharge a voltage level of the first node to the k-th carry signal in response to the clock signal.

2. The gate driving circuit of claim 1, wherein the second discharge unit is further configured to discharge the first node to a second ground voltage comprising the first voltage and the k-th gate signal to a first ground voltage in response to the discharge signal, and wherein the first ground voltage and the second ground voltage comprise different voltage levels.

3. The gate driving circuit of claim 2, wherein the second discharge unit is configured to discharge the k-th carry signal to the second ground voltage.

4. A gate driving circuit comprising driving stages for providing gate signals to gate lines of a display panel, wherein a k-th driving stage (k being a natural number equal to or greater than 2) among the driving stages comprises:

a gate output unit configured to output a clock signal as a k-th gate signal of the gate signals in response to a voltage of a first node;

a carry output unit configured to output the clock signal as a k-th carry signal in response to the voltage of the first node;

a control unit configured to control the voltage of the first node in response to a (k−1)th carry signal from a (k−1)th driving stage among the driving stages;

a first discharge unit configured to discharge the k-th carry signal to a first voltage in response to the (k−1)th carry signal, and comprising a single first discharge transistor comprising a first electrode configured to receive the k-th carry signal, a second electrode configured to receive the first voltage, and a control electrode configured to receive the (k−1)th carry signal; and a second discharge unit configured to discharge the k-th carry signal to the first voltage in response to a (k+1)th carry signal from an output of a (k+1)th driving stage among the driving stages, the second discharge unit being directly connected to the output of the (k+1)th driving stage.

5. The gate driving circuit of claim 1, wherein the second discharge unit comprises a second discharge transistor comprising a first electrode configured to receive the k-th carry signal, a second electrode configured to receive a second ground voltage, and a control electrode configured to receive a (k+1)th carry signal.

6. The gate driving circuit of claim 1, wherein the glitch prevention unit is configured to maintain the voltage of the first node as a level of the k-th carry signal in response to the clock signal.

7. The gate driving circuit of claim 3, wherein the discharge signal comprises an inversion clock signal that is complementary to the clock signal.

8. The gate driving circuit of claim 7, wherein the second discharge unit comprises a second discharge transistor comprising a first electrode configured to receive the k-th carry signal, a second electrode configured to receive the second ground voltage, and a control electrode configured to receive the (k+1)th carry signal.

9. The gate driving circuit of claim 8, wherein the second discharge unit further comprises:

a third discharge transistor comprising a first electrode configured to receive the k-th gate signal, a second electrode configured to receive the first ground voltage, and a control electrode configured to receive the inversion clock signal;

a fourth discharge transistor comprising a first electrode configured to receive the k-th gate signal, a second electrode configured to receive the first ground voltage, and a control electrode configured to receive the (k+1) th carry signal; and a fifth discharge transistor comprising a first electrode connected to the first node, a second electrode configured to receive the second ground voltage, and a control electrode configured to receive the (k+1)th carry signal.

10. The gate driving circuit of claim 8, wherein the second discharge unit further comprises a sixth discharge transistor comprising a first electrode configured to receive the k-th carry signal, a second electrode configured to receive the second ground voltage, and a control electrode configured to receive the inversion clock signal.

11. The gate driving circuit of claim 3, wherein the discharge signal comprises an inversion clock signal complementary to the (k+1)th carry signal, a (k+2)th carry signal, and the clock signal.

12. The gate driving circuit of claim 11, wherein the second discharge unit comprises a second discharge transistor comprising a first electrode configured to receive the k-th carry signal, a second electrode configured to receive the second ground voltage, and a control electrode configured to receive the (k+1)th carry signal.

13. The gate driving circuit of claim 12, wherein the second discharge unit comprises a seventh discharge transistor comprising a first electrode connected to the first node, a second electrode configured to receive the second ground voltage, and a control electrode configured to receive the (k+2)th carry signal.

14. A display device comprising:

a display panel comprising a plurality of pixels for displaying an image, a plurality of gate lines for receiving gate signals for driving the plurality of pixels, and a plurality of data lines for receiving data signals;

a gate driving circuit on the display panel and configured to supply the gate signals to the plurality of gate lines; and a data driving circuit configured to supply the data signals to the plurality of data lines, wherein the gate driving circuit comprises driving stages for providing the gate signals to the gate lines, and wherein a k-th driving stage (k being a natural number of two or more) among the driving stages comprises:

a gate output unit configured to output a clock signal received from a clock terminal of the k-th driving stage as a k-th gate signal of the gate signals in response to a voltage of a first node;

a carry output unit configured to output the clock signal as a k-th carry signal in response to the voltage of the first node;

a control unit configured to control the voltage of the first node in response to a (k−1)th carry signal;

a first discharge unit configured to discharge the k-th carry signal to a first voltage in response to the (k−1)th carry signal, and comprising a single first discharge transistor comprising a first electrode configured to receive the k-th carry signal, a second electrode configured to receive the first voltage, and a control electrode configured to receive the (k−1)th carry signal;

a second discharge unit configured to discharge the k-th carry signal to the first voltage in response to a (k+1)th carry signal; and a glitch prevention unit comprising a transistor comprising a first electrode connected to the first node, a second electrode configured to receive the k-th carry signal, and a control electrode directly connected to the clock terminal and configured to receive the clock signal, wherein the transistor of the glitch prevention unit is configured to discharge a voltage level of the first node to the k-th carry signal in response to the clock signal.

15. The display device of claim 14, wherein the second discharge unit is further configured to discharge the first node to a second ground voltage comprising the first voltage and the k-th gate signal to a first ground voltage in response to the (k+1)th carry signal, and wherein the first ground voltage and the second ground voltage comprise different voltage levels.

16. The display device of claim 15, wherein the second discharge unit is configured to the second ground voltage.

17. The display device of claim 16, wherein the first discharge unit comprises a first discharge transistor comprising a first electrode configured to receive the k-th carry signal, a second electrode configured to receive the second ground voltage, and a control electrode configured to receive the (k−1)th carry signal, and wherein the second discharge unit comprises a second discharge transistor comprising a first electrode configured to receive the k-th carry signal, a second electrode configured to receive the second ground voltage, and a control electrode configured to receive the (k+1)th carry signal.

* * * * *